US005134055A

United States Patent [19]

Okamura et al.

[11] Patent Number: 5,134,055

[45] Date of Patent: Jul. 28, 1992

[54] SILVER HALIDE PHOTOGRAPHIC MATERIALS

[75] Inventors: Hisashi Okamura; Hisashi Okada; Morio Yagihara; Kazunobu Katoh; Keiji Mihayashi, all of Kanagawa, Japan

[73] Assignee: Fuji Photo Film Co., Ltd., Kanagawa, Japan

[21] Appl. No.: 512,221

[22] Filed: Apr. 20, 1990

[30] Foreign Application Priority Data

Apr. 21, 1989 [JP] Japan ..... 1-102395
Nov. 8, 1989 [JP] Japan ..... 1-290563

[51] Int. Cl.[5] ..... G03C 5/54; G03C 1/42; G03C 7/26; G03C 1/06

[52] U.S. Cl. ..... 430/264; 430/223; 430/564; 430/559; 430/566; 430/598; 430/955; 430/957; 430/959

[58] Field of Search ..... 430/223, 264, 598, 955, 430/957, 564, 959, 566, 559

[56] References Cited

U.S. PATENT DOCUMENTS

| | | | |
|---|---|---|---|
| 3,227,551 | 1/1966 | Barr et al. | 430/957 |
| 3,628,952 | 12/1971 | Puschel et al. | 430/223 |
| 3,844,785 | 10/1974 | Puschel et al. | 430/223 |
| 4,248,962 | 2/1981 | Lau | 430/382 |
| 4,323,643 | 4/1982 | Mifune et al. | 430/598 |
| 4,619,884 | 10/1986 | Singer | 430/223 |
| 4,684,604 | 8/1987 | Harder | 430/223 |
| 4,950,578 | 8/1990 | Yagihara et al. | 430/264 |
| 4,971,890 | 11/1990 | Okada et al. | 430/264 |
| 4,977,063 | 12/1990 | Usagawa et al. | 430/598 |
| 4,999,276 | 3/1991 | Kuwabara et al. | 430/264 |
| 5,006,445 | 4/1991 | Yagihara et al. | 430/264 |

*Primary Examiner*—Richard L. Schilling

*Attorney, Agent, or Firm*—Sughrue, Mion, Zinn, Macpeak & Seas

[57] ABSTRACT

A silver halide photographic material is disclosed, which has at least one compound represented general formula (1):

$$R-Y-NH-L-NHNH-\underset{\underset{O}{\|}}{C}(Time)_t-PUG \quad (1)$$

wherein R represents an aliphatic group, an aromatic group, or a heterocyclic group; both L and Time represent a divalent organic group; t represents 0 or 1; PUG represents a photographically useful group; Y represents $-SO_2-$, $-Y'-SO_2-$, or $$-Y'-\overset{\overset{O}{\|}}{\underset{\underset{R-Y'}{|}}{P}}-;$$

and Y' represents —O—, —NH—, or $$-\underset{\underset{R}{|}}{N}-.$$

The material has a broad exposure latitude in line image-taking work and has a high resolving power in the work. It can form an ultrahard image having a high gamma value of 10 or more. The material may excellently reproduce a line original to form an ultrahard image having a high background density. It also has a broad exposure latitude in halftone dot image-taking work and can form a halftone dot image having ultrahigh contrast with high image quality.

6 Claims, 1 Drawing Sheet

SILVER HALIDE PHOTOGRAPHIC MATERIALS

FIELD OF THE INVENTION

The present invention relates to silver halide photographic materials and, more precisely, to materials that contain a compound of releasing a photographically useful group usable in the processing step.

BACKGROUND OF THE INVENTION

Hitherto, compounds of a group that may release a photographically useful group via a redox reaction are known.

For instance, there are the compounds described in JP-A-61-213847 and JP-A-61-278852 (the term "JP-A" as used herein refers to a "published unexamined Japanese patent application") and U.S. Pat. No. 4,684,604.

The known compounds are used for various purposes in accordance with the kind of the photographically useful group to be released therefrom, as so mentioned in the patent publications above.

For instance, in the photomechanical printing field, photographic materials capable of giving high quality reproductions that are stable in a variety of processing solutions as well as simplified replenishment systems are desired for the purpose of meeting the wide variety of diversified and complicated print forms that are now common.

Originals that need to be reproduced and to be employed in a line work process are often composed of a variety of forms such as phototypeset letters, handwritten letters, illustrations, and halftone dot image photographs. These originals almost always contain plural images having different concentration of tone and different line widths, in combination. Photomechanical cameras and photographic materials capable of accurately copying the images from such originals to yield photographic material with good reproducibility as well as image-forming methods applicable to such photographic materials are earnestly desired.

For example, current techniques for producing catalogs or large-sized posters either blow-up or reduce dot image photographs. If the application involves enlarged dot images, the dots must be coarsened which ultimately gives blurred photoprints. If the application requires a reduction of the original, fine dots with an enlarged ratio of the line number per inch must be photographed. Accordingly, the image-forming method having a much broader latitude is desired for the purpose of maintaining the reproducibility of halftone dot image gradation.

A common light source for a photomechanical process camera is a halogen or xenon lamp. In order to obtain sufficient sensitivity to these light sources, the photographic material employed is generally ortho-sensitized. However, it has been found that ortho-sensitized photographic materials are greatly influenced by chromatic aberration of lens and therefore the quality of the images formed are frequently worsened by ortho-sensitization. It has also been found that the deterioration of image quality is more noticeable when a xenon light source is used.

An attempt to satisfy the demand for a broad latitude photographic material for photomechanical printing processes is a lith-type silver halide photographic material composed of silver chlorobromide (having a silver chloride content of at least 50% or more). This lith-type material is processed with a hydroquinone-containing developer having an effective concentration of sulfite ion that is extremely low (generally, to 0.1 mol/liter or less) to thereby obtain a line image or halftone dot image having high contrast and high blackened density where image portions and nonimage portions are clearly differentiated from each other. However, lith-type material and methods of using it have various drawbacks. Because the sulfite concentration in the developer employed in the method is very low, development is extremely unstable due to aerial oxidation. Stabilizing development thus requires additional means and additives. In addition, the processing speed is extremely slow, and the working efficiency is poor.

An improved image-forming system is therefore desired which is free from the problems of the lith-development system, one which may be processed with a processing solution that has excellent storage stability, and one that gives photographic images having ultrahard photographic characteristics. Examples of systems capable of forming an ultrahard negative image having a gamma value of more than 10 have been proposed, such as those in U.S. Pat. Nos. 4,166,742, 4,168,977, 4,221,857, 4,224,401, 4,243,739, 4,272,606 and 4,311,781. In these patents, a surface latent image-type silver halide photographic material containing a particular acylhydrazine compound is processed with a developer which has an excellent storage stability and which contains a sulfite preservative in an amount of 0.15 mol/liter or more, at a pH value of from 11.0 to 12.3. The image-forming system of each of these patents is capable of processing silver iodobromide or silver chloroiodobromide-containing photographic material, although only high silver chloride content silver chlorobromide photographic material can be processed by previously known ultrahard image-forming methods. While these image-forming systems are excellent for forming images with sharp halftone dot image quality, the processes proceed stably at high speed, and the reproducibility of the image formed is good, further improvement in reproducibility is still desired that will satisfactorily deal with a variety of diversified print forms.

Another way of improving the quality of photomechanical process printing images involves imagewise release of a development inhibitor from redox compounds having a carbonyl group, as illustrated in JP-A-61-213847. However, even employing such compounds, the improvement in halftone dot image gradation of the image formed is still insufficient.

A photographic material is therefore needed which, when developed with a stable developer, provides a high contrast dot image whose tone is broadly controllable.

On the other hand, improvement in working efficiency in a plate making process and dot-to-dot work has been attempted by performing the work in a brighter environment. Accordingly, photographic materials for plate making which can be handled in an environment that may be called a bright room and exposure printers for these materials have been developed.

Photographic materials for daylight use referred to herein mean those which can be safely used for a long period of time under a safelight substantially having a wavelength of 400 nm or more without ultraviolet components.

Daylight photographic materials to be used in plate making work and dot-to-dot work are those which are utilized for negative image/positive image conversions or positive image/positive image conversions where an original of a developed film having letter or halftone dot images thereon is contacted with the dot-to-dot working photographic material for contact exposure. In addition, these materials are required to satisfy the following requirements:

(1) In a negative image/positive image conversion, halftone dot images, as well as line images and letter images, can be converted in accordance with the dot area, line width and letter image width.

(2) Tone regulation of the halftone dot images, as well as regulation of the line width of the letter and line images, is possible.

Various photographic materials for daylight dot-to-dot work which might satisfy these requirements are available.

However, in high technological image conversion work for forming superimposed letter images by dot-to-dot work, the conventional methods of conducting daylight dot-to-dot work using a daylight photographic material is inferior to dark dot-to-dot work method of using the conventional dark dot-to-dot work photographic materials. That is, the quality of the superimposed letter images of the former is worse than the images formed by the latter.

The method of forming superimposed letter images by dot-to-dot work will be explained in more detail with reference to FIG. 1.

In FIG. 1, transparent or semitransparent supports (a) and (c) (generally, polyethylene terephthalate film having a thickness of approximately 100 μm is used) are attached to a letter or line image film (line original) (b) and a halftone dot image film (halftone original) (d), respectively, to form a combined original. A dot-to-dot working photographic material (e) is contacted with the halftone original (d) and with the emulsion surface of the material (e) facing the halftone image surface of the original (d). The material is then exposed to light through the combined original by contact exposure.

After exposure, the material is developed to form transparent line image portions in the dot images.

The important point in this method of forming superimposed letter images is that the negative image/positive image conversion is ideally effected in accordance with the dot area and the line width of the halftone original and the line original, respectively. However, as is apparent from FIG. 1, the halftone original (d) is in intimate contact with the emulsion layer of the photographic material (e). On the other hand, the line original (b) is not directly superposed on the material (e), but with the support (c) and the halftone original (d) being interposed therebetween.

Accordingly, if an exposure sufficient for faithful negative/positive conversion of the halftone original is used, the line original would be out-of-focus because of the space created by the support (c) and the halftone original (d), and the line width in the transparent line image portions in the dot images formed is too narrow. This is the reason for the decrease in quality of the transparent line image portion in the dot images formed.

In order to overcome the above-mentioned problems, a system of using hydrazine has been proposed, for example, as illustrated in JP-A-62-80640, JP-A-62-235938, JP-A-62-235939, JP-A-63-104046, JP-A-63-103235, JP-A-63-396031, JP-A-63-314541 and JP-A-64-13545. However, these hydrazine systems are not sufficient to improve the reproducibility of a dot image gradation, the quality of a superimposed letter image and the reproducibility of a line image, and further improvement is desired.

In color photographic materials, redox compounds capable of releasing a development inhibitor for the purpose of improving the sharpness, improving the graininess and improving the color reproducibility are effective. However, the conventional compounds are unsatisfactory for sufficiently improving the photographic properties of photographic materials of these days which have been increasingly diversified and high leveled. Accordingly, further improvement of the compounds is desired.

It is inevitable that the high sensitized color photographic materials which have been developed recently often sacrifice the sharpness and graininess thereof in some degree for the purpose of elevating the sensitivity thereof. Additionally, disc-size photographic films have poor graininess and sharpness as the enlarged magnification in printing is great.

Moreover, black-and-white photographic materials for X-ray exposure are desired to have an improved sharpness.

SUMMARY OF THE INVENTION

Accordingly, one object of the present invention is to provide a high sensitized photographic material which is able to produce excellent image quality of high sharpness, graininess, resolving power, and color reproducibility and has a broad exposure latitude.

Another object of the present invention is to provide a silver halide photographic material for photomechanical printing processes, which has a broad exposure latitude in line image work, has a high resolving power, and is able to form ultrahigh contrast images (especially having a gamma value of 10 or more).

Still another object of the present invention is to provide a silver halide photographic material for photomechanical printing processes, which has a broad exposure latitude in a halftone dot image reproduction and is able to form ultrahigh contrast halftone dot images having high density, and clear, well-shaped outlines of the dot image formed and thus produce excellent image quality.

The objects of the present invention have been attained by a silver halide photographic material containing a compound of the following general formula (1):

$$R-Y-NH-L-NHNH-\underset{\underset{O}{\|}}{C}(Time)_t-PUG \qquad (1)$$

wherein R represents an aliphatic group, an aromatic group or a heterocyclic group; L represents a divalent organic group; Time represents a divalent organic group; t represents 0 or 1; PUG represents a photographically useful group; Y represents $-SO_2-$, $-Y'-SO_2-$ or $$-Y'-\overset{\overset{O}{\|}}{\underset{\underset{R-Y'}{|}}{P}}-;$$

and Y' represents —O—, —NH— or

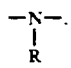

DETAILED DESCRIPTION OF THE INVENTION

Figure 1A:
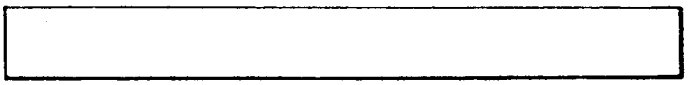
FIG. 1 shows an embodiment of formation of superimposed letter images using a dot-to-tot work, where (a) is a transparent or semitransparent support, (b) is a line original in which the black portions indicate line images, (c) is a transparent or semitransparent support, (d) is a halftone original in which the black portions indictate dot images, and (e) is a dot-to-dot photographic material in which the shadow portion indicates a light-sensitive layer.

The compounds of formula (1) are explained in detail below.

The aliphatic group represented by R includes a linear, branched or cyclic alkyl group, alkenyl group or alkynyl group, which preferably has from 1 to 30 carbon atoms. The branched alkyl group may be cyclized to form a saturated hetero ring containing one or more hetero atoms therein.

For example, the group R may be a methyl group, a t-butyl group, an n-octyl group, a t-octyl group, a cyclohexyl group, a hexenyl group, a pyrrolidyl group, a tetrahydrofuryl group, or an n-dodecyl group.

The aromatic group represented by R may be a monocyclic or a bicyclic aryl group, for example, a phenyl group, or a naphthyl group.

The heterocyclic group represented by R can be a 3-membered to 10-membered unsaturated or saturated heterocyclic group having at least one hetero atom of nitrogen, oxygen, or sulfur, it may be monocyclic or may form a condensed ring with other aromatic ring(s) and/or hetero ring(s). The hetero ring is preferably a 5- or 6-membered aromatic hetero ring, for example, a pyridine ring, an imidazolyl ring, a quinolinyl group, a benzimidazolyl group, a pyrimidinyl group, a pyrazolyl group, an isoquinolinyl group, a benzothiazolyl group, or a thiazolyl gorup.

The group represented by R may optionally be substituted by one or more substituents. In addition, these substituent groups may be further substituted.

For example, the substituents may be an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl gorup, an alkylthio group, an arylthio group, an alkyl- or arylsulfonyl group, an alkyl- or arylsulfinyl group, a hydroxyl group, a halogen atom, a cyano gorup, a sulfo group, an alkyloxycarbonyl group, an aryloxycarbonyl group, an acyl group, an acyloxy group, a carbonamido group, a sulfonamido group, or a carboxyl group.

If possible, these groups may also be bound to each other to form a ring.

The divalent organic group represented by L may be an aliphatic gorup, an aromatic group, or a group of the following structural formula:

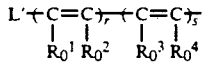

wherein L' represents an aromatic group or a heterocyclic group; $R_0^1$ to $R_0^4$ each independently represents a hydrogen atom, a halogen atom, or an alkyl group; and r and s each represents 0 or 1.

The aliphatic group which may be represented by L is a linear, branched, or cyclic alkylene group, alkenylene group, or alkynylene group.

The aromatic group which may be represented by L is a monocyclic or bicyclic arylene group, for example, a phenylene group, or a naphthylene group. Especially preferred is a phenylene group.

L is more preferably a 1,4-phenylene group or a 1,2-phenylene group.

The group represented by L may optionally have one or more substituents. These substituents include a group of R—Y—NH— and those as referred to, above, as substituents on R.

Time represents a divalent organic group which may have a timing adjustment function. t means 0 or 1; and when t is 0, PUG is directly bound to the carbonyl group in the formula.

A divalent organic group for Time is a group capable of releasing PUG from the moiety Time-PUG which is released from the oxidation product of the redox nucleus. This release can be via a one step reaction or a reaction having plural steps.

Examples of the divalent organic group for Time include those which release PUG by an intramolecular ring closure reaction of p-nitrophenoxy derivatives as described in U.S. Pat. No. 4,248,962 (JP-A-54-145135); groups that release PUG by a ring cleavage reaction followed by an intramolecular ring closure reaction as described in U.S. Pat. No. 4,310,612 (JP-A-55-53330) and U.S. Pat. No. 4,358,525; groups that release PUG by an intramolecular ring closure reaction of the carboxyl group of succinic acid monoesters or their analogs with formation of an acid anhydride as described in U.S. Pat. Nos. 4,330,617, 4,446,216 and 4,483,919 and JP-A-59-121328; groups that release PUG by an electron transfer of the aryloxy or heterocyclic oxy group via the conjugated double bond to form a quinomonomethane or its analog as described in U.S. Pat. Nos. 4,409,323, 4,421,845, *Research Disclosure*, Item No. 21228 (December, 1981), U.S. Pat. No. 4,416,977 (JP-A-57-135944) and JP-A-58-209736 and JP-A-58-209738; groups that release PUG by electron transfer of the enamine structure moiety of the nitrogen-containing ring from the gamma position of the enamine as described in U.S. Pat. No. 4,420,554 (JP-A-57-136640), JP-A-57-135945, JP-A-57-188035, JP-A-58-98728 and JP-A-58-209737; groups that release PUG by an intramolecular ring closure reaction of the hydroxyl group formed by electron transfer of the carbonyl group conjugated with the nitrogen atom of the nitrogen-containing hetero ring as described in JP-A-57-56837; groups that release PUG with formation of aldehydes as described in U.S. Pat. No. 4,146,396 (JP-A-52-90932), JP-A-59-93442, JP-A-59-75475, JP-A-60-249148 and JP-A-60-249149; groups that release PUG with the decarbonylation of the carboxyl group as described in JP-A-51-146828, JP-A-57-179842 and JP-A-59-104641; groups having —O—$COOCR_2R_6$—PUG that release PUG by decarbonylation followed by formation of aldehydes; groups that release PUG by formation of isocyanates as described in JP-A-60-7429; and groups that release PUG by a coupling reaction with the oxidation product of a color developing agent as described in U.S. Pat. No. 4,438,193.

Preferably, the divalent group represented by Time in formula (1) may be selected from those of the following formulae (T-1) to (T-6), where (*) indicates the position where Time is bonded to

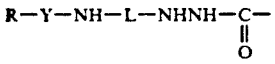

and (**) indicates the position where Time is bonded to PUG.

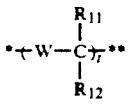

(T-1)

wherein W represents an oxygen atom, a sulfur atom or

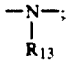

$R_{11}$ and $R_{12}$ each independently represents a hydrogen atom or a substituent; $R_{13}$ represents a substituent; t represents 1 or 2, and when t is 2, two

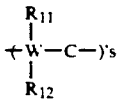

may be the same or different.

Where $R_{11}$ and $R_{12}$ are substituents, specific examples of the substituents are $R_{14}$, $R_{14}CO$—, $R_{14}SO_2$—,

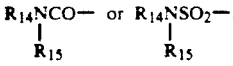

$R_{14}$ represents an aliphatic group, an aromatic group or a heterocyclic group; and $R_{15}$ represents an aliphatic group, an aromatic group, a heterocyclic group, or a hydrogen atom. Examples of the substituents as $R_{13}$ include the same substituents as $R_{11}$ and $R_{12}$ as described above. $R_{11}$, $R_{12}$ and $R_{13}$ each may be a divalent group to form a cyclic structure.

Specific examples of the groups represented by formula (T-1) are mentioned below.

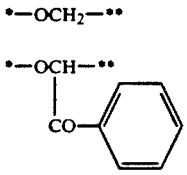

-continued

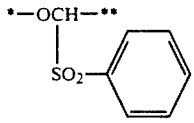

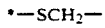

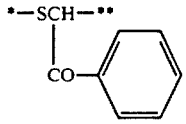

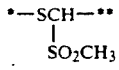

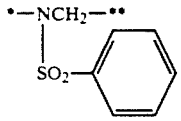

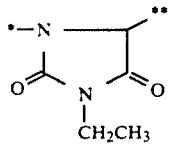

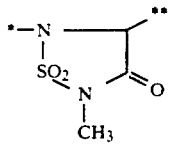

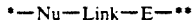

(T-2)

wherein Nu represents a nucleophilic group, and an oxygen atom or a sulfur atom are examples of nucleophilic nuclides; E represents an electrophilic group and it is nucleophilically attacked by Nu to be able to cleave the bond to the position of (**); Link represents a linking group which participates in the steric configuration of Nu and E so that Nu and E may be subjected to intramolecular nucleophilic substitution reaction therebetween.

Specific examples of the groups represented by formula (T-2) are mentioned below.

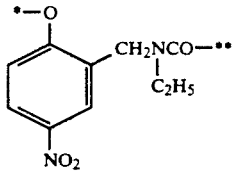

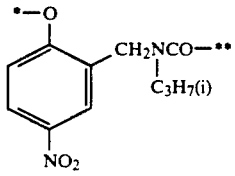

-continued
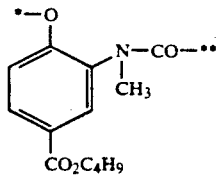
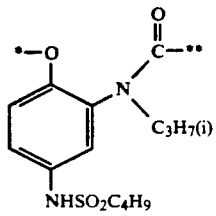
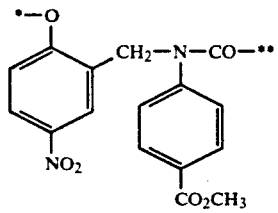
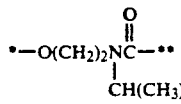
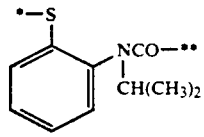
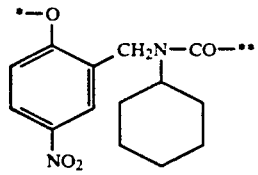
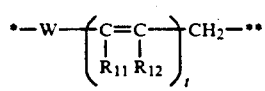
(T-3)
wherein W, $R_{11}$, $R_{12}$ and t have the same meaning as those in formula (T-1). Specific examples of the groups of formula (T-3) are mentioned below.
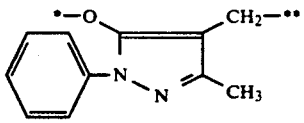
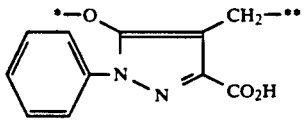
-continued
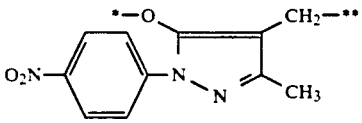
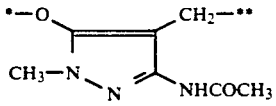
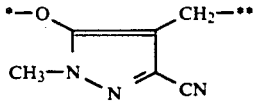
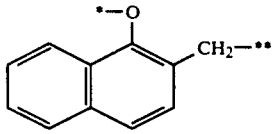
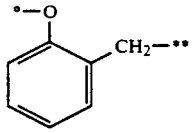
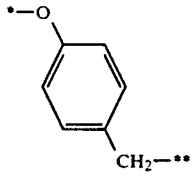
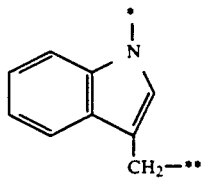
(T-4)
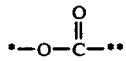
(T-5)
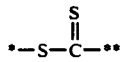
(T-6)
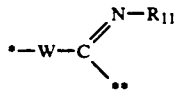
In these formulae, W and $R_{11}$ have the same meanings as those in formula (T-1). Specific examples of the groups of formula (T-6) are mentioned below.
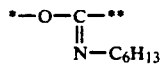

-continued
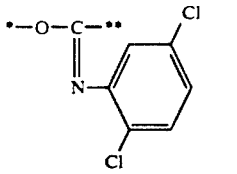
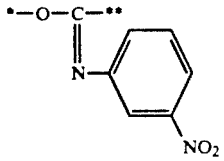
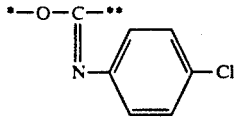
-continued
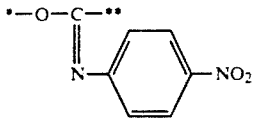
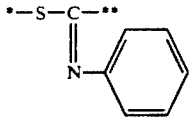
Specific examples of the divalent organic groups for Time are also described in detail in JP-A-61-236549 and JP-A-64-88451 and Japanese Patent Application No. 63-98803. Preferred examples of these groups are mentioned below.
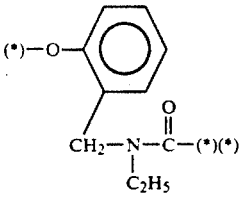
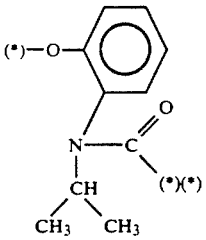
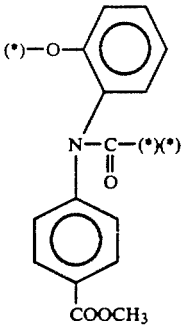
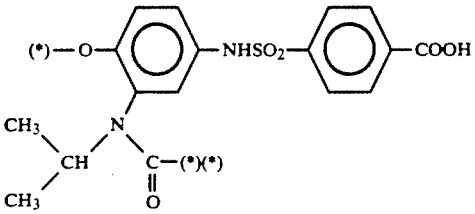

-continued
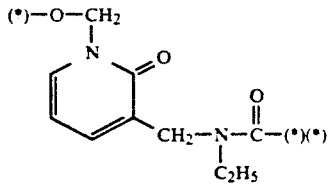
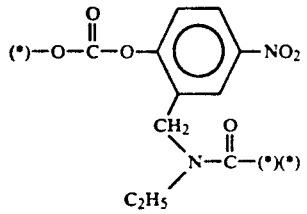
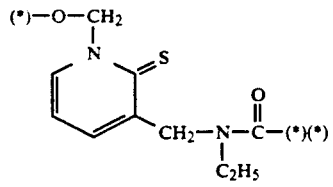
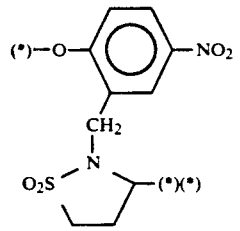
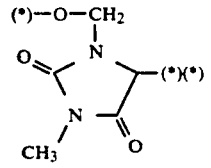
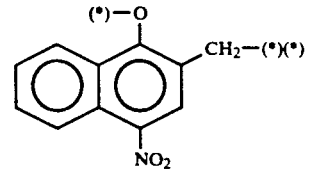
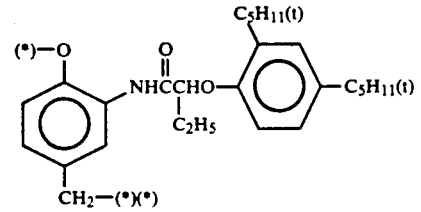

-continued
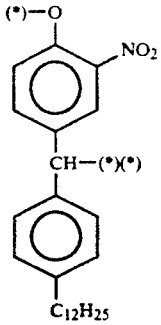
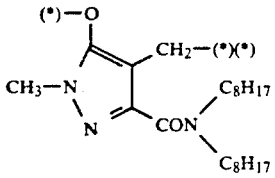
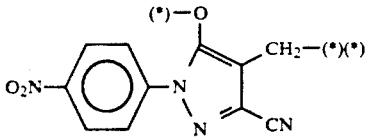
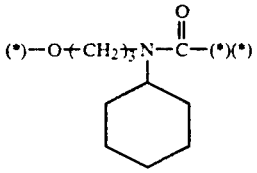
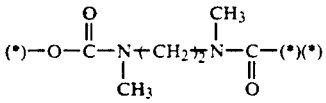
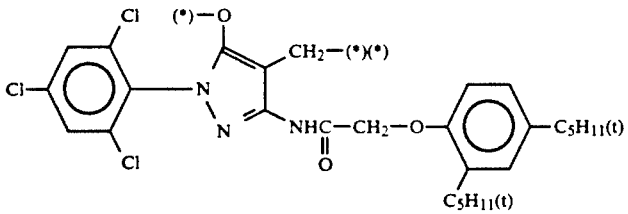
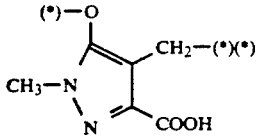
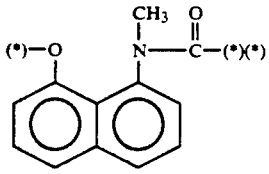

-continued

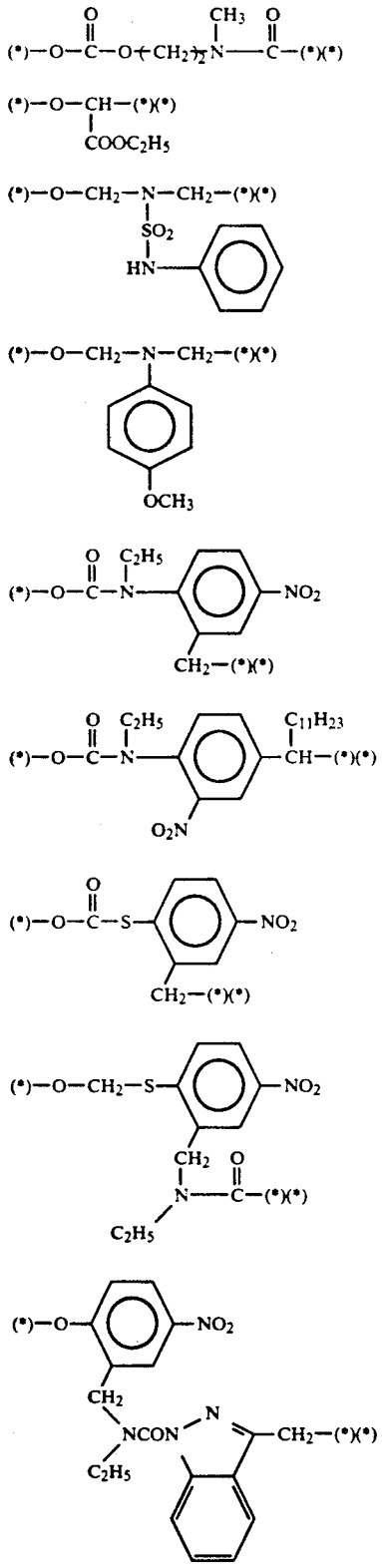

The group PUG represents a photographically useful compound that can be present as either $(Time)_r$-PUG or PUG.

Examples of photographically useful groups are development inhibitors, development accelerators, nucleating agents, foggants, couplers, diffusible or nondiffusible dyes, desilvering accelerators, desilvering inhibitors, silver halide solvents, competing compounds, developing agents, auxiliary developing agents, fixation accelerators, fixation inhibitors, image stabilizers, color toning agents, processing dependence improving agents, dot improving agents, color image stabilizers, photographic dyes, surfactants, hardening agents, desensitizing agents, contrast enhancing agents, chelating agents, brightening agents, acids, bases, and precursors of acids or bases.

Examples of these photographically useful compounds are described in, for example, T. H. James, *The Theory of the Photographic Process*, 4th Ed. (published by Macmillan, 1977). More precisely, development inhibitors, dyes, couplers and developing agents are described in detail in U.S. Pat. No. 4,248,962; foggants in JP-A-59-170840; and desilvering accelerators (bleach accelerators) in JP-A-62-168159.

Photographically useful groups often overlap with each other with respect to their usefulness. As a typical exampl of the group, a development inhibitor is discussed in detail below.

The development inhibitor represented by PUG or $(Time)_t$-PUG may be a known development inhibitor containing hetero atoms. Such an inhibitor is bound to $$R-Y-NH-L-NHNH-\underset{\underset{O}{\|}}{C}-$$

in formula (I) via the hetero atom. Examples of such development inhibitors are described, for example, in C. E. K. Mees and T. H. James, *The Theory of Photographic Processes*, 3rd Ed. (published by Macmillan 1966), pages 344 to 346. They include, for example, mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes and mercaptoaryls.

The development inhibitors represented by PUG may optionally be substituted. In addition, these substituents may be further substituted.

An example of a group that may be a substituent is an alkyl group, an aralkyl group, an alkenyl group, an alkynyl group, an alkoxy group, an aryl group, a substituted amino group, a ureido group, a urethane group, an aryloxy group, a carbamoyl group, an alkylthio group, an arylthio gorup, an alkyl- or arylsulfonyl group, an alkyl- or arylsulfinyl group, a hydroxyl group, a halogen atom, a cyano group, an aryloxycarbonyl group, an acyl group, an alkoxycarbonyl group, an acyloxy group, a carbonamido group, a sulfoxy group, or a phosphoric acid amido group. When the development inhibitors represented by PUG have a nitro group, it is preferred that t in $(Time)_t$ is 1.

Specific examples of usable development inhibitors are described below.

1. Mercaptotetrazole Derivatives (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Chlorophenyl)-5-mercaptotetrazole
(5) 1-(4-Methylphenyl)-5-mercaptotetrazole
(6) 1-(2,4-Dihydroxyphenyl)-5-mercaptotetrazole
(7) 1-(4-Methoxyphenyl)-5-mercaptotetrazole
(8) 1-(2-Methoxyphenyl)-5-mercaptotetrazole
(9) 1-[4-(2-Hydroxyethoxy)phenyl]-5-mercaptotetrazole
(10) 1-(2,4-Dichlorophenyl)-5-mercaptotetrazole
(11) 1-(4-Dimethylaminophenyl)-5-mercaptotetrazole
(12) 1-(4-Nitrophenyl)-5-mercaptotetrazole
(13) 1,4-Bis(5-mercapto-1-tetrazolyl)benzene
(14) 1-(α-Naphthyl)-5-mercaptotetrazole
(15) 1-(β-Naphthyl)-5-mercaptotetrazole
(16) 1-Methyl-5-mercaptotetrazole
(17) 1-Ethyl-5-mercaptotetrazole
(18) 1-Propyl-5-mercaptotetrazole
(19) 1-Octyl-5-mercaptotetrazole
(20) 1-Dodecyl-5-mercaptotetrazole
(21) 1-Cyclohexyl-5-mercaptotetrazole
(22) 1-Palmityl-5-mercaptotetrazole
(23) 1-Carboxyethyl-5-mercaptotetrazole
(24) 1-(2,2-Diethoxyethyl)-5-mercaptotetrazole
(25) 1-(2-Aminoethyl)-5-mercaptotetrazole Hydrochloride
(26) 1-(2-Diethylaminoethyl)-5-mercaptotetrazole
(27) 2-(5-Mercapto-1-tetrazolyl)ethyltrimethylammonium Chloride
(28) 1-(3-Phenoxycarbonylphenyl)-5-mercaptotetrazole
(29) 1-(3-Maleimidophenyl)-5-mercaptotetrazole 2. Mercaptotriazole Derivatives (1) 4-Phenyl-3-mercaptotriazole
(2) 4-Phenyl-5-methyl-3-mercaptotriazole
(3) 4,5-Diphenyl-3-mercaptotriazole
(4) 4-Methyl-3-mercaptotriazole
(5) 4-(2-Dimethylaminoethyl)-3-mercaptotriazole
(6) 4-(α-Naphthyl)-3-mercaptotriazole
(7) 4-(3-Nitrophenyl)-3-mercaptotriazole 3. Mercaptoimidazole Derivatives (1) 1-Phenyl-2-mercaptoimidazole
(2) 1,5-Diphenyl-2-mercaptoimidazole
(3) 1-(4-Hexylcarbamoyl)-2-mercaptoimidazole
(4) 1-(3-Nitrophenyl)-2-mercaptoimidazole 4. Mercaptopyrimidine Derivatives (1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives (1) 2-Mercaptobenzimidazole
(2) 5-Amino-2-mercaptobenzimidazole
(3) 5-Nitro-2-mercaptobenzimidazole
(4) 5-Chloro-2-mercaptobenzimidazole
(5) 5-Methoxy-2-mercaptobenzimidazole
(6) 2-Mercaptonaphthoimidazole
(7) 1-(2-Hydroxyethyl)-2-mercaptobenzimidazole
(8) 5-Caproamido-2-mercaptobenzimidazole
(9) 5-(2-Ethylhexanoylamino)-2-mercaptobenzimidazole 6. Mercaptothiadiazole Derivatives (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 2-Phenoxycarbonylmethylthio-5-mercapto-1,3,4-thiadiazole 7. Mercaptobenzothiazole Derivatives (1) 2-Mercaptobenzothiazole (2) 5-Nitro-2-mercaptobenzothiazole 8. Mercaptobenzoxazole Derivatives (1) 2-Mercaptobenzoxazole
(2) 5-Nitro-2-mercaptobenzoxazole 9. Benzotriazole Derivatives (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Methoxycarbonylbenzotriazole
(12) 5-Aminobenzotriazole
(13) 5-Butoxybenzotriazole
(14) 5-Ureidobenzotriazole
(15) Benzotriazole
(16) 5-Phenoxycarbonylbenzotriazole
(17) 5-(2,3-Dichloropropyloxycarbonyl)benzotriazole 10. Benzimidazole Derivatives (1) Benzimidazole
(2) 5-Chlorobenzimidazole
(3) 5-Nitrobenzimidazole
(4) 5-N-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole Derivatives (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole 12. Tetrazole Derivatives (1) 5-(4-Nitrophenyl)tetrazole
(2) 5-Phenyltetrazole 13. Tetraazaindene Derivatives (1) 4-Hydroxy-6-methyl-5-nitro-1,3,3a,7-tetraazaindene
(2) 4-Mercapto-6-methyl-5-nitro-1,3,3a,7-tetraazaindene 14. Mercaptoaryl Derivatives (1) 4-Nitrothiophenol
(2) Thiophenol In formula (1), the group R or -(Time)$_r$-PUG may contain a ballast group which is generally contained in a nondiffusible photographic additive such as a coupler or a gorup that accelerates adsorption of the compound of formula (1) to silver halide grains.

The ballast group usable for this purpose is an organic group which may give sufficient molecular weight to the compound of formula (1) so that the compound would not substantially diffuse into other layers or into the processing solution. The ballast group is composed of one or more of the following groups: an alkyl gorup, an aryl group, a heterocyclic group, an ether group, a thioether group, an amido group, a ureido group, a urethane group, or a sulfonamido group. Preferably, the ballast group contains a substituted benzene ring; especially preferred is ballast gorup having a benzene ring substituted with a branched alkyl group.

Examples of groups that accelerate the adsorption of the compound of formula (1) to silver halides are the following: cyclic thioamido groups (such as 4-thiazoline-2-thione, 4-imidazoline-2-thione, 2-thiohydantoin, rhodanine, thiobarbituric acid, tetrazoline-5-thione, 1,2,4-triazoline-3-thione, 1,2,4-oxazoline-2-thione, benzimidazoline-2-thione, benzoxazoline-2-thione, benzothiazoline-2-thione, thiotriazine and 1,3-imidazoline-2-thione); chain thioamido groups; aliphatic mercapto groups; aromatic mercapto groups; heterocyclic mercapto groups (when a nitrogen atom is adjacent to the carbon atom bonded to —SH, the groups have the same meaning as the cyclic thioamido groups which are tautomers of the groups, and specific examples of the groups are the same as those mentioned above); groups containing disulfido bond; 5-membered or 6-membered nitrogen-containing heterocyclic groups composed of a combination of nitrogen, oxygen, sulfur and carbon atoms (such as benzotriazoles, triazoles, tetrazoles, indazoles, benzimidazoles, imidazoles, benzothiazoles, thiazoles, thiazolines, benzoxazoles, oxazoles, oxazolines, thiadiazoles, oxathiazoles, triazines, azaindenes); and heterocyclic quaternary salts such as benzimidazoliniums.

These groups may further be substituted, if desired. Examples of these substituents are those discussed as representative of R, above.

Specific examples of compounds of formula (1) employable in the present invention are given below. These are not, however, intended to limit the present invention.

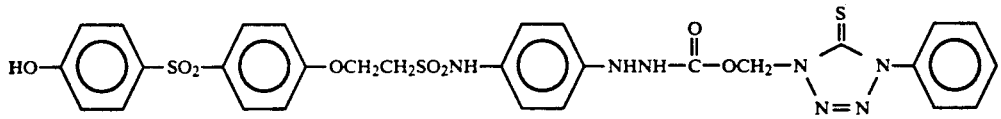

1

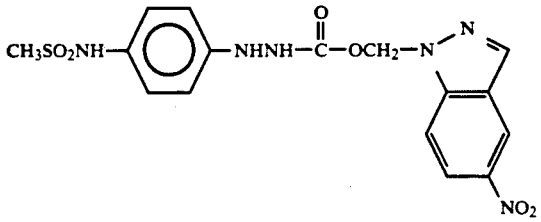

2

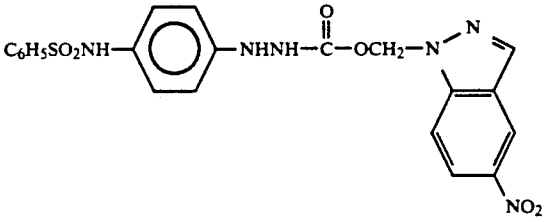

3

-continued
4
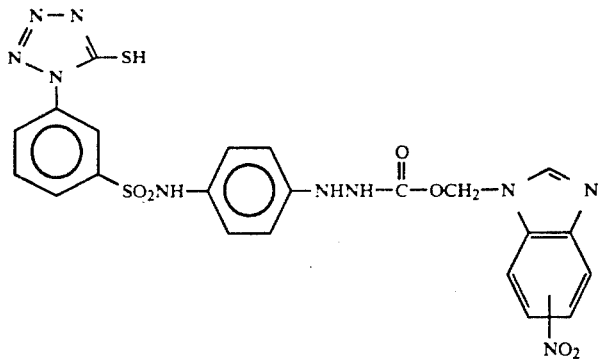
5
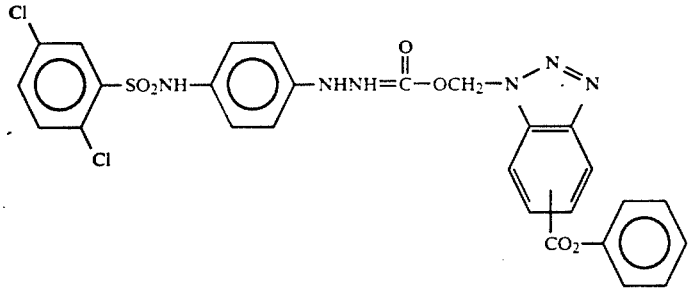
6
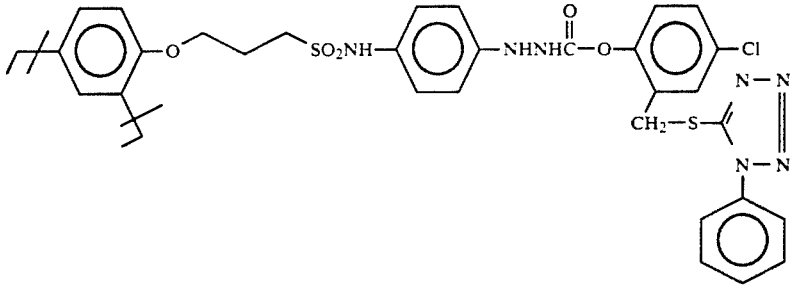
7
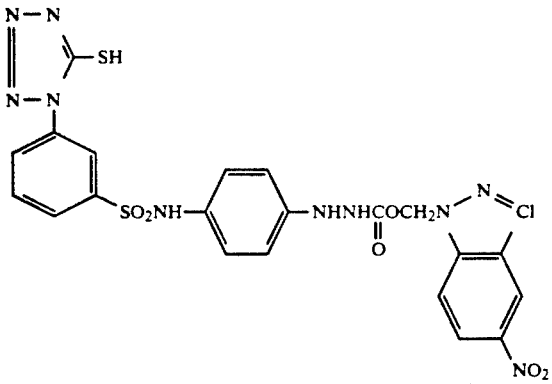
8
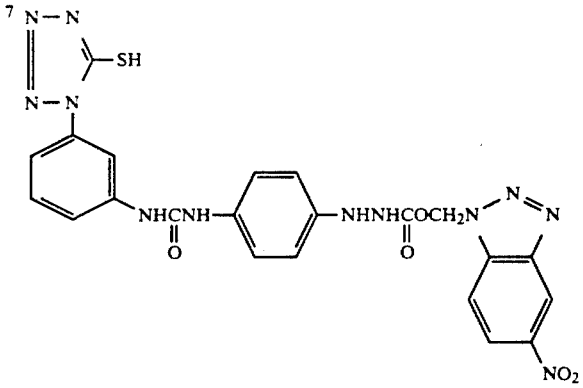
9
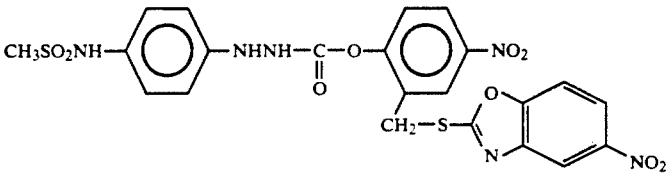

-continued
10
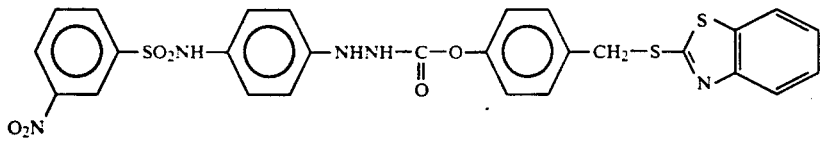
11
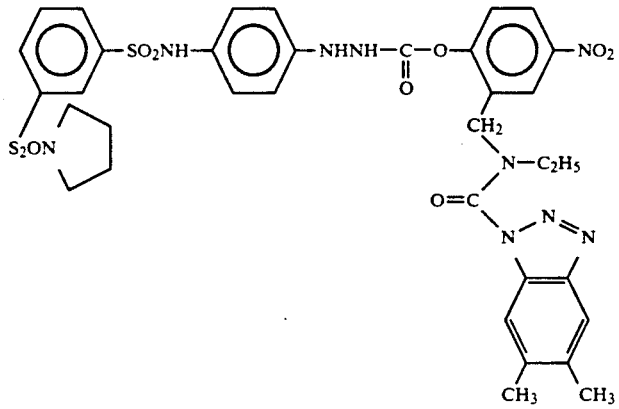
12
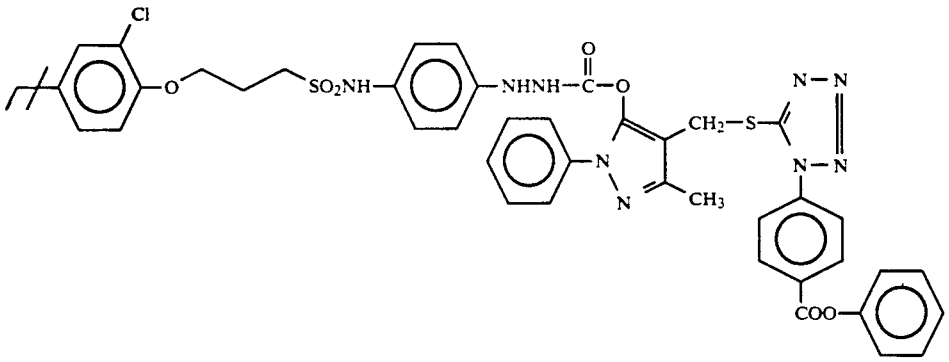
13
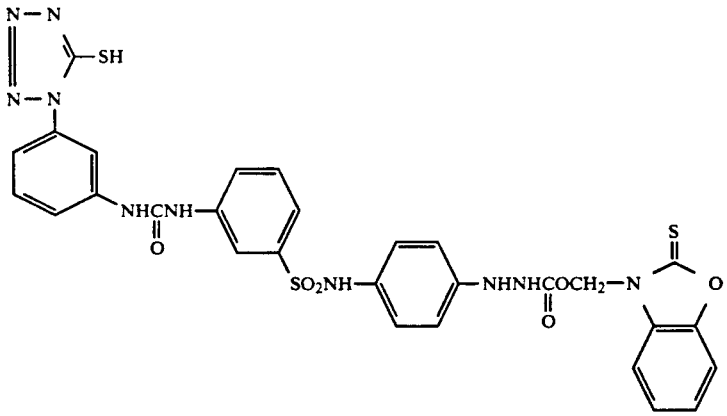
14
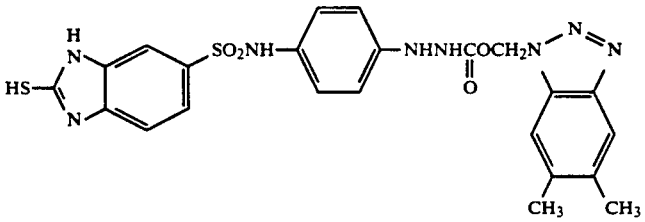

-continued
15
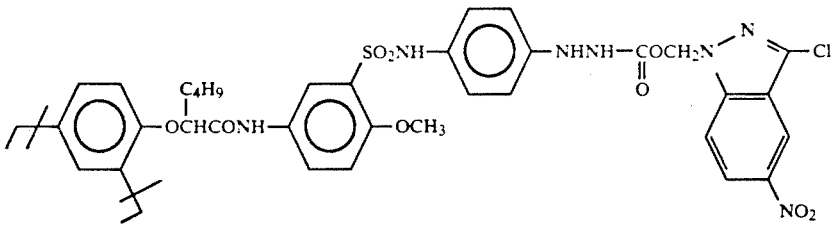
16
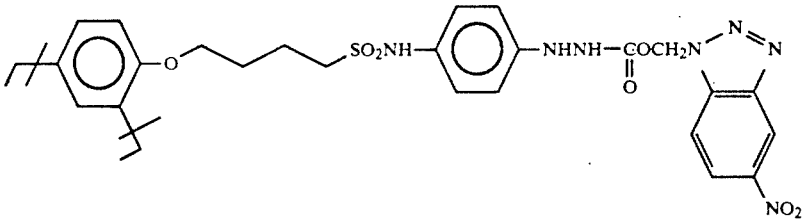
17
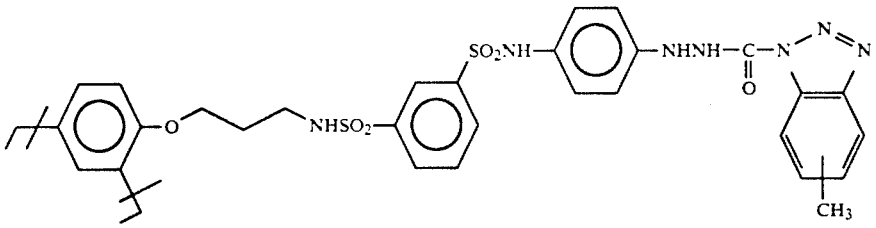
18
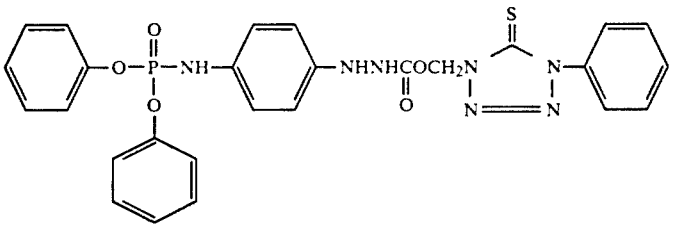
19
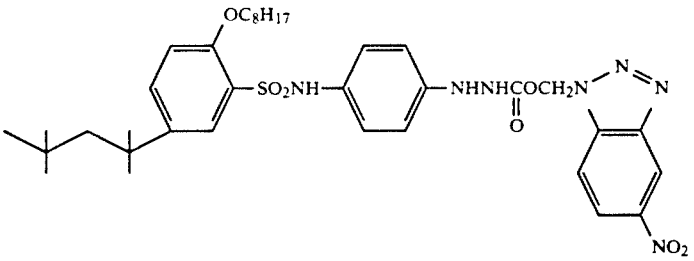
20
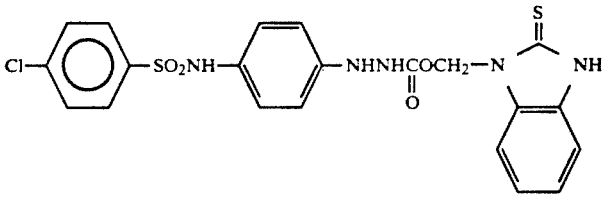
21
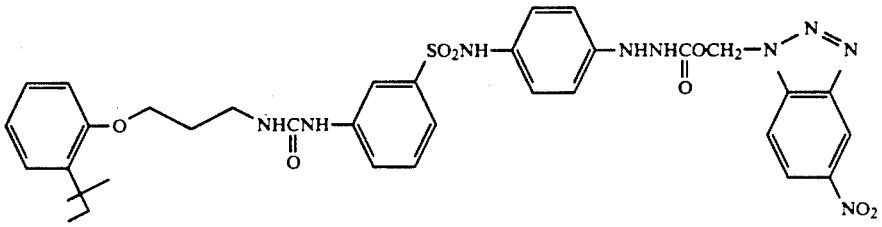

-continued
22
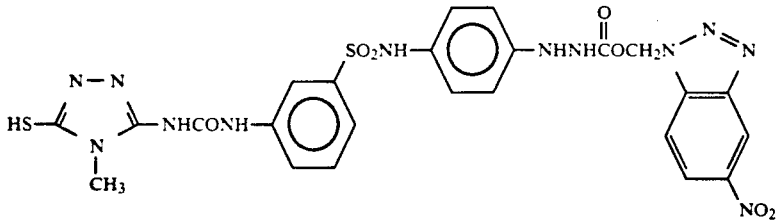
23
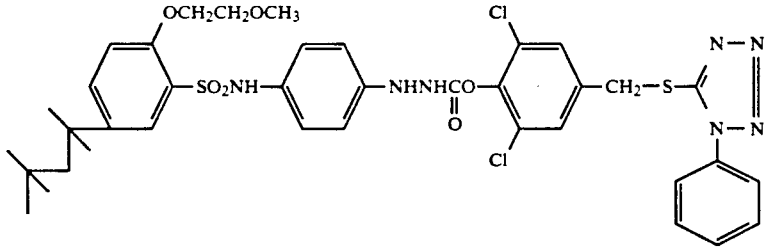
24
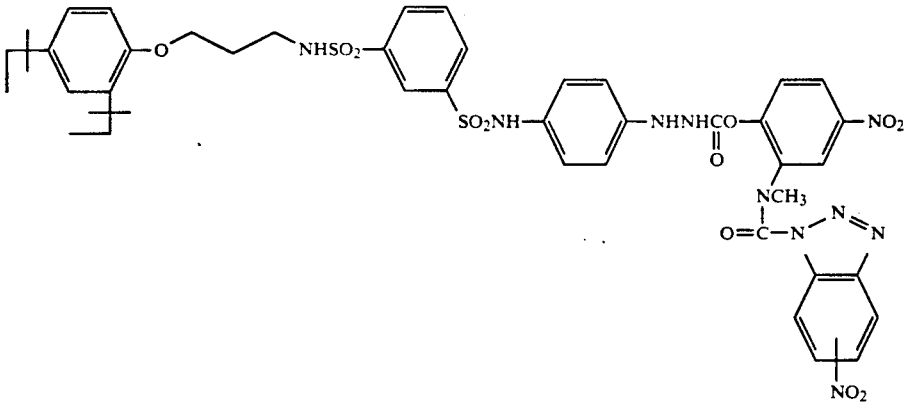
25
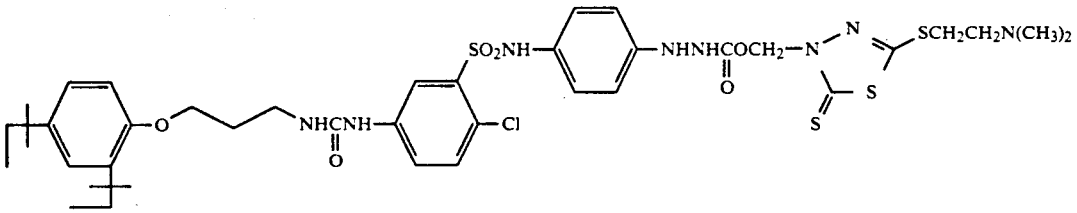
26
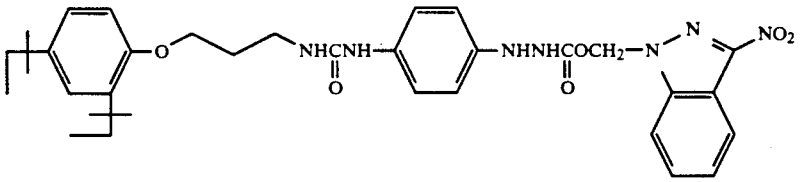
27
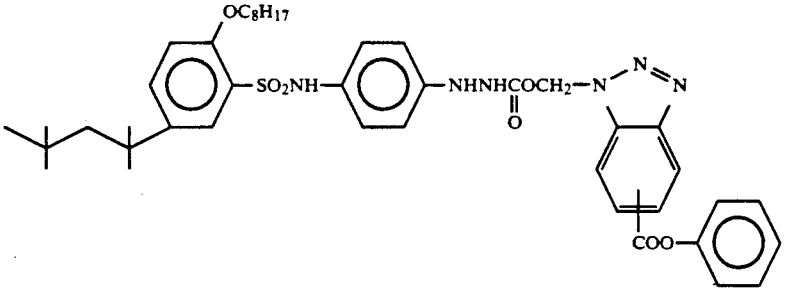

-continued
28
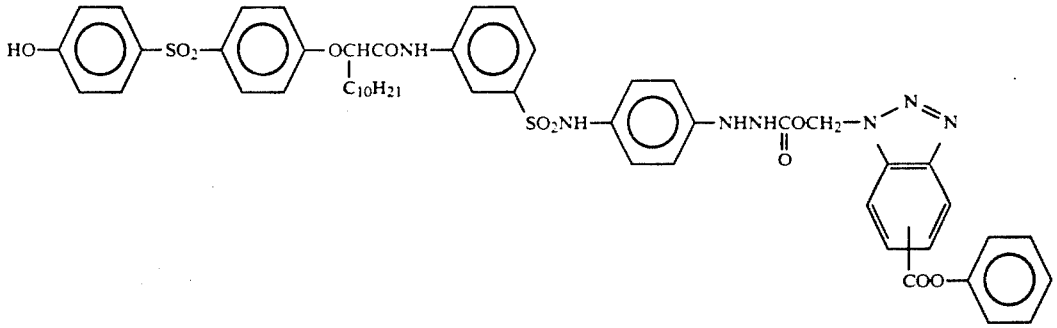
29
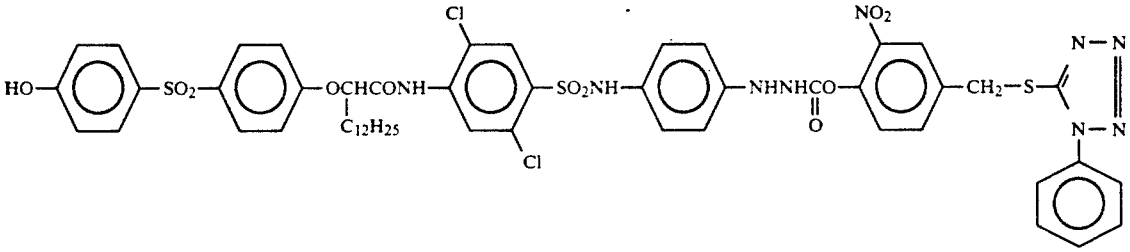
30
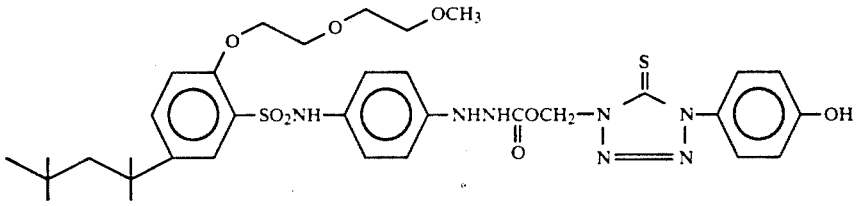
31
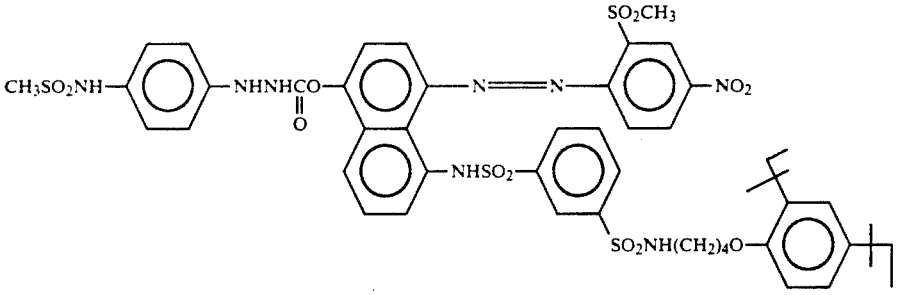
32
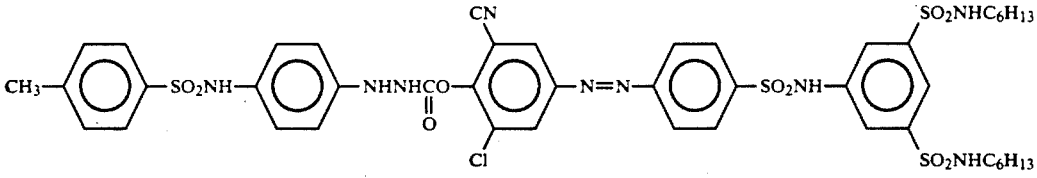
33
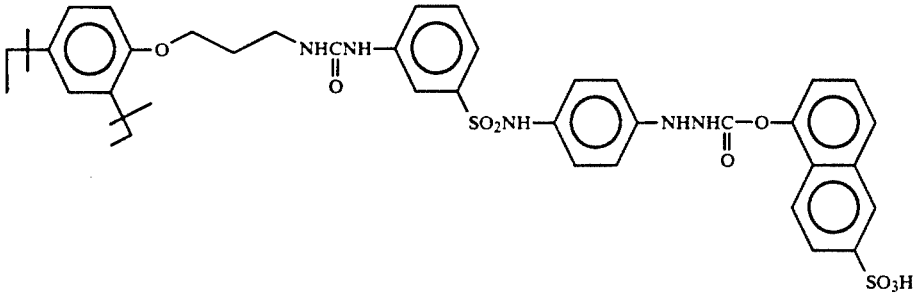

-continued

34

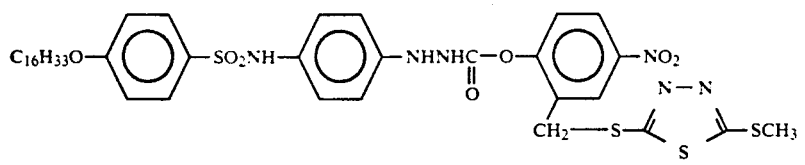

35

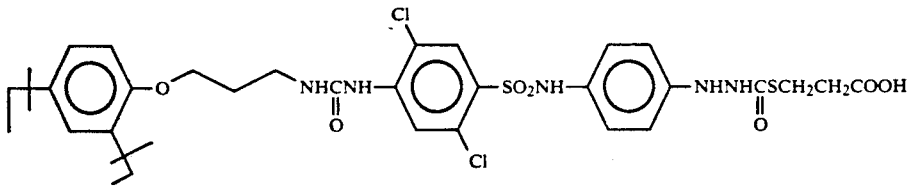

36

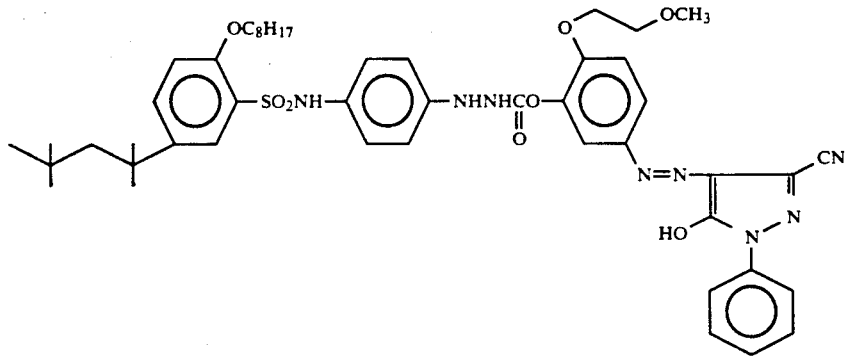

The compounds of formula (1) used in the present invention are produced in accordance with the methods described in JP-A-61-213847 and JP-A-62-260153, U.S. Pat. No. 4,684,604, and Japanese Patent Application No. 63-98803.

The compounds of formula (1) can be incorporated into the photographic emulsion layer or hydrophilic colloid layer of the silver halide photographic materials of the present invention. The compound of formula (1) may be first dissolved in water or in a water-miscible organic solvent (if desired, in the presence of an alkali hydroxide or a tertiary amine for salt formation), the resulting solution may then be added to the hydrophilic colloid liquid (such as silver halide emulsion or aqueous gelatin solution), and the pH of the resulting colloid liquid may be adjusted by addition of an acid or alkali, if desired.

The compounds of formula (1) can be employed singly or in combinations of two or more when incorporated into the photographic material. The amount of the compound of formula (1) to be added to the photographic material is preferably from $1\times10^{-6}$ to $5\times10^{-2}$ mol, more preferably from $1\times10^{-5}$ to $1\times10^{-2}$ mol, per mol of the silver halide in the material. A pertinent amount may be added, as known in the art, in accordance with the properties of the silver halide emulsion combined with the compound.

The compound of formula (1) is preferably employed in combination with a hydrazine derivative of general formula (2).

$$R_{31}-\underset{\underset{A_1}{|}}{N}-\underset{\underset{A_2}{|}}{N}-G_1-R_{32} \qquad (2)$$

wherein $R_{31}$ represents an aliphatic group or an aromatic group; $R_{32}$ represents a hydrogen atom, an alkyl group, an aryl group, an alkoxy group, an aryloxy group, an amino group, a carbamoyl group, or an oxycarbonyl group; $G_1$ represents a $$-\overset{\overset{O}{\|}}{C}-\text{ group, an } -SO_2- \text{ group, an } -SO- \text{ group,}$$

$$\text{a } -\underset{\underset{R_{32}}{|}}{\overset{\overset{O}{\|}}{P}}- \text{ group, a } -\overset{\overset{O}{\|}}{C}-\overset{\overset{O}{\|}}{C}- \text{ group,}$$

a thiocarbonyl group, or an iminomethylene group; and both $A_1$ and $A_2$ are hydrogen atoms, or one of them is a hydrogen atom and the other represents a substituted or unsubstituted alkylsulfonyl group, a substituted or unsubstituted arylsulfonyl group, or a substituted or unsubstituted acyl group.

In formula (2), the aliphatic group represented by $R_{31}$ is preferably a linear, branched or cyclic alkyl group having from 1 to 30 carbon atoms, more preferably from 1 to 20 carbon atoms. The branched alkyl groups may be cyclized to form a saturated hetero ring containing one or more hetero atoms. The alkyl groups may optionally be substituted by the following substituent(s): an aryl group, an alkoxy group, a sulfoxy group, a sulfonamido group, or a carbonamido group.

In formula (2), the aromatic group represented by $R_{31}$ is a monocyclic or bicyclic aryl group or unsaturated heterocyclic group. The unsaturated heterocyclic group may be condensed with a monocyclic or bicyclic aryl group to form a hetero aryl group.

Examples of these groups are a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Especially preferred is a benzene ring.

$R_{31}$ is most preferably an aryl group.

The aryl group or unsaturated heterocyclic group represented by $R_{31}$ may optionally be substituted. Typical substituents are an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, an alkyl- or arylsulfonyl group, an alkyl or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, an imido group, and an

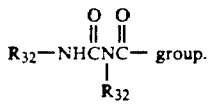

Preferably, the substituents are a linear, branched, or cyclic alkyl group (preferably having from 1 to 20 carbon atoms), an aralkyl group (preferably a monocyclic or bicyclic group where the alkyl moiety has from 1 to 3 carbon atoms), an alkoxy group (preferably having from 1 to 20 carbon atoms), a substituted amino group (preferably an amino group substituted by one or more alkyl groups each having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), or a phosphoric acid amido group (preferably having from 1 to 30 carbon atoms).

In formula (2), the alkyl group represented by $R_{32}$ is preferably an alkyl group having from 1 to 4 carbon atoms, which may be optionally substituted by the following substituent(s): a halogen atom, a hydroxyl group, a cyano group, a carboxyl group, a sulfo group, an alkoxy group, a phenyl group, an alkyl- or arylsulfonyl group, an acyl group, an alkoxycarbonyl group, an aryloxycarbonyl group, a carbamoyl group, a sulfamoyl group, a nitro group, a heterocyclic aromatic group, or an

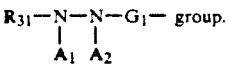

These groups may further be substituted.

The aryl group represented b $R_{32}$ is preferably a monocyclic or bicyclic aryl group, for example, containing a benzene ring. The aryl group may be optionally substituted by substituent(s), such as, for example, a halogen atom, an alkyl group, a cyano group, a carboxyl group, a sulfo group, or a sulfonyl group.

The alkoxy group represented by $R_{32}$ is preferably an alkoxy group having from 1 to 8 carbon atoms, which may be optionally substituted by one or more substituents that are either a halogen atom or an aryl group.

The aryloxy group represented by $R_{32}$ is preferably monocyclic, and may be optionally substituted by a halogen atom or the like.

The amino group represented by $R_{32}$ is preferably an unsubstituted amino group, an alkylamino group having from 1 to 10 carbon atoms, or an arylamino group. It may be optionally substituted by one or more of the following substituents: an alkyl group, a halogen atom, a cyano group, a nitro group, and/or a carboxyl group.

The carbamoyl group represented b $R_{32}$ is preferably an unsubstituted carbamoyl group, or an alkylcarbamoyl group having from 1 to 10 carbon atoms or an arylcarbamoyl group. It may be optionally substituted by one or more of the following substituents: an alkyl group, a halogen atom, a cyano group, and/or a carboxyl group.

The oxycarbonyl group represented by $R_{32}$ is preferably an alkoxycarbonyl group having from 1 to 10 carbon atoms or an aryloxycarbonyl group, and it may be optionally substituted by one or more of the following substituents: an alkyl group, a halogen atom, a cyano group, and/or a nitro group.

Where $G_1$ is

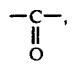

$R_{32}$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl, 2-hydroxymethylphenyl); and it is most preferably a hydrogen atom.

Where $G_1$ is $—SO_2—$, $R_{32}$ is preferably an alkyl group (e.g., methyl), an aralkyl group (e.g., o-hydroxybenzyl), an aryl group (e.g., phenyl), or a substituted amino group (e.g., dimethylamino).

Where $G_1$ is —SO—, $R_{32}$ is preferably a cyanobenzyl group or a methylthiobenzyl group.

Where $G_1$ is

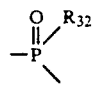

group, $R_{32}$ is preferably a methoxy group, an ethoxy group, a butoxy group, a phenoxy group, or a phenyl group; most preferably a phenoxy group.

Where $G_1$ is an N-substituted or unsubstituted iminomethylene group, $R_{32}$ is preferably a methyl group, an ethyl group, or a substituted or unsubstituted phenyl group.

Substituents on $R_{32}$, if any, are the same as those mentioned for $R_{31}$, above.

In formula (2), $G_1$ is most preferably a

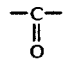

group.

$R_{32}$ may also be such a group that causes release of the $—G_1—R_{32}$ moiety from the remaining molecule followed by a cyclization reaction to form a cyclic structure containing the atoms of the thus released $—G_1—R_{32}$ moiety. Such an $R_{32}$ group is represented by the following formula (a):

$$—R_{33}—Z_{31} \quad \text{(a)}$$

wherein $Z_{31}$ represents a group which nucleophilically attacks the group $G_1$ to cleave the $—G_1—R_{33}—Z_{31}$ moiety from the remaining molecule; where $R_{33}$ represents a group derived from $R_{32}$ by the removal of one hydrogen atom. In the group represented by formula (a), $Z_{31}$ nucleophilically attacks $G_1$ and, as a result, $G_1$, $R_{33}$ and $Z_{31}$ form a cyclic structure.

More precisely, $Z_{31}$ is a group that easily reacts nucleophilically with $G_1$, when the hydrazine compound of formula (2) forms a reaction intermediate of:

$$R_{31}—N{=}N—G_1—R_{33}—Z_{31}$$

by oxidation, thereby cleaving the $R_{31}—N{=}N—$ moiety from group $G_1$. Specifically, $Z_{31}$ may be a functional goup which directly reacts with group $G_1$, such as OH, SH or $NHR_{34}$ (where $R_{34}$ represents a hydrogen atom, an alkyl group, an aryl group, $—COR_{35}$, or $—SO_2R_{35}$; and $R_{35}$ represents a hydrogen atom, an alkyl group, an aryl group or a heterocyclic group), or COOH, these groups OH, SH, $NHR_{34}$, and COOH, may be temporarily protected so that the free group is formed by hydrolysis with an alkali or the like. Alternatively, $Z_{31}$ may also be a functional group which may react with the $G_1$ group after reacting with a nucleophilic agent such as a hydroxyl ion or a sulfite ion. Examples of such functional groups are $$—\overset{\overset{N—R_{37}}{\|}}{C}—R_{36} \quad \text{or} \quad —\overset{\overset{O}{\|}}{C}—R_{36}$$

(where $R_{36}$ and $R_{37}$ each represents a hydrogen atom, an alkyl group, an alkenyl group, an aryl group, or a heterocyclic group).

The ring formed by $G_1$, $R_{33}$ and $Z_{31}$ is preferably a 5-membered or 6-membered one.

Of the formula (a) groups, those represented by the following formulae (b) and (c) are preferred.

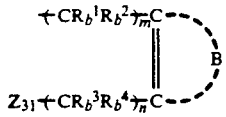

(b)

wherein $R_b^1$ to $R_b^4$ each represents a hydrogen atom, an alkyl group (preferably having from 1 to 12 carbon atoms), an alkenyl group (preferably having from 2 to 12 carbon atoms), or an aryl group (preferably having from 6 to 12 carbon atoms), and these may be the same or different; B represents an atomic group necessary for completing an optionally substituted 5-membered or 6-membered ring; and m and n each represents 0 or 1 where (n+m) is 1 or 2.

Examples of 5-membered or 6-membered rings formed by B are a cyclohexene ring, a cyclopentene ring, a benzene ring, a naphthalene ring, a pyridine ring, and a quinoline ring.

$Z_{31}$ in formula (b) represents the same groups as it does in formula (a), above.

$$\overset{\overset{R_c^3}{|}}{+N+_p}+CR_c^1R_c^2+_q Z_{31} \qquad (c)$$

wherein $R_c^1$ and $R_c^2$ each represents a hydrogen atom, an alkyl group, an alkenyl group, an aryl group, or a halogen atom, and these may be the same or different; $R_c^3$ represents a hydrogen atom, an alkyl group, an alkenyl group, or an aryl group; and p represents 0 or 1, and q represents 1, 2, 3, or 4.

$R_c^1$, $R_c^2$ and $R_c^3$ may be bonded to each other to form a ring, provided that $Z_{31}$ has a structure capable of attacking group $G_1$ by an intramolecular nucleophilic reaction.

$R_c^1$ and $R_c^2$ each are preferably a hydrogen atom, a halogen atom, or an alkyl group; and $R_c^3$ is preferably an alkyl group or an aryl group.

q is preferably 1, 2, or 3. When q is 1, p is 1; when q is 2, p is 0 or 1; when q is 3, p is 0 or 1; and when q is 2 or 3, the plural $(—CR_c^1R_c^2)$'s may be the same or different.

$Z_{31}$ in formula (c) represents the same groups as it does in formula (a), above.

$A_1$ and $A_2$ each represents a hydrogen atom; an alkylsulfonyl or arylsulfonyl group having 20 or less carbon atoms (preferably an unsubstituted phenylsulfonyl group or a phenylsulfonyl group so substituted that the total of the Hammett's substituent constants is −0.5 or more); an acyl group having 20 or less carbon atoms (preferably an unsubstituted benzoyl group or a benzoyl group so substituted that the total of the Hammett's substituent constants is −0.5 or more); or a linear, branched or cyclic substituted or unsubstituted aliphatic acyl group (where the substituents of the group are, for example, a halogen atom, an ether group, a sulfonamido group, a carbonamido group, a hydroxyl group, a carboxyl group, or a sulfonic acid group).

$A_1$ and $A_2$ are most preferably hydrogen atoms.

$R_{31}$ or $R_{32}$ in formula (2) may have a ballast group which is generally present in a nondiffusible photographic additive such as a coupler. The ballast group is a group which is relatively inactive in terms of photographic properties and has 8 or more carbon atoms. Examples of ballast groups are an alkyl group, an alkoxy group, a phenyl group, an alkylphenyl group, a phenoxy group, or an alkylphenoxy group.

$R_{31}$ or $R_{32}$ in formula (2) may have a group which functions to enhance the adsorption of the compound of formula (2) to the surface of silver halide grains. Examples of such adsorbing groups are thiourea groups, heterocyclic thioamido groups, mercaptoheterocyclic groups, triazole groups as well as the groups mentioned in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234246, and Japanese Patent Application No. 62-67501.

Specific nonlimiting examples of compounds of formula (2) are given below.

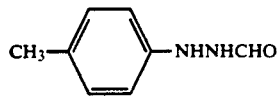

2-1)

-continued
2-2)
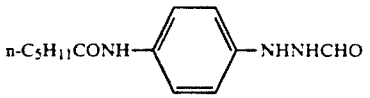
2-3)
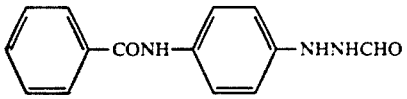
2-4)
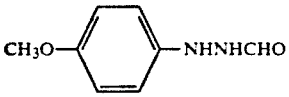
2-5)
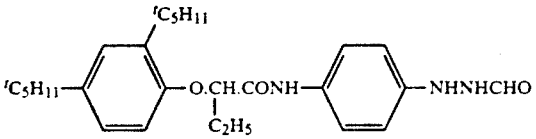
2-6)
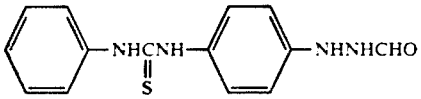
2-7)
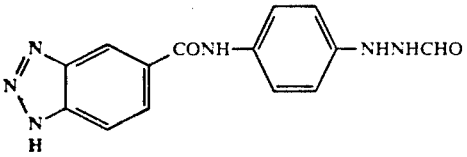
2-8)
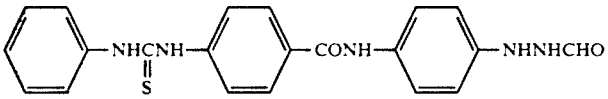
2-9)
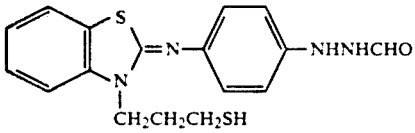
2-10)
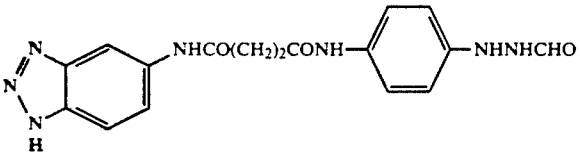
2-11)
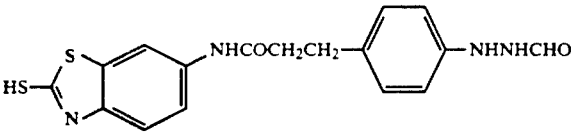
2-12)
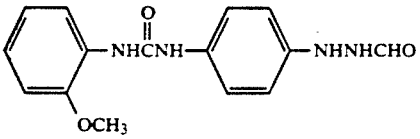

-continued
2-13)
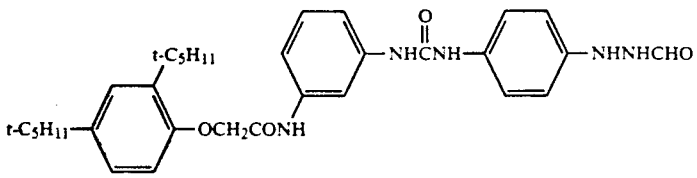
2-14)
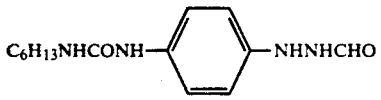
2-15)
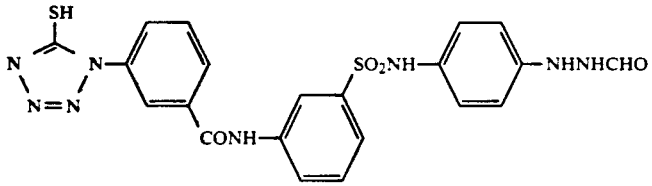
2-16)
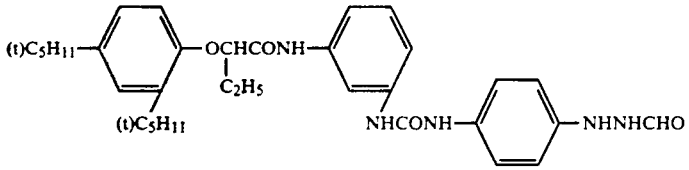
2-17)
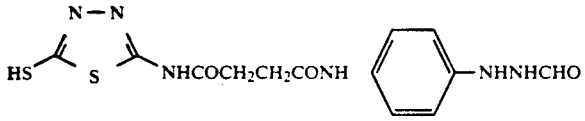
2-18)
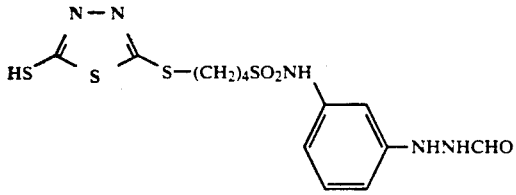
2-19)
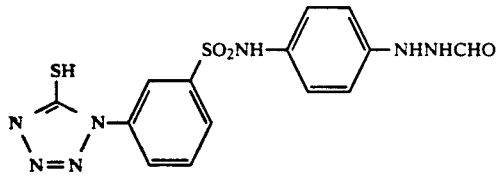
2-20)
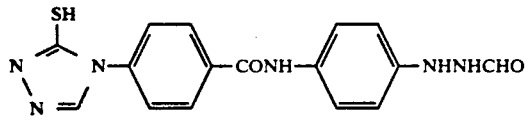
2-21)
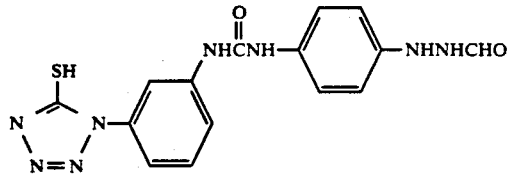

-continued
2-22)
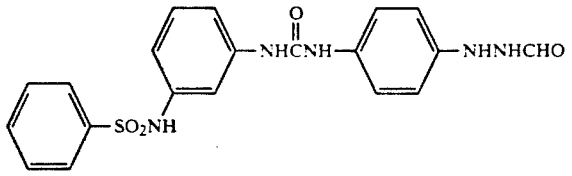
2-23)
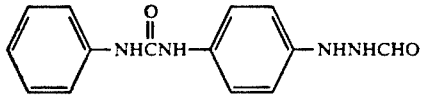
2-24)
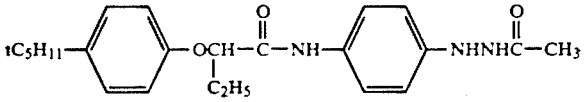
2-25)
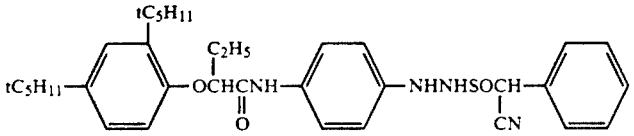
2-26)
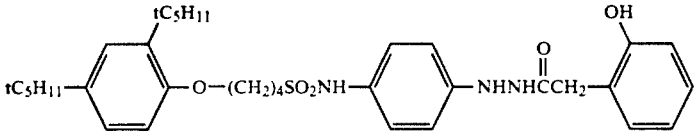
2-27)
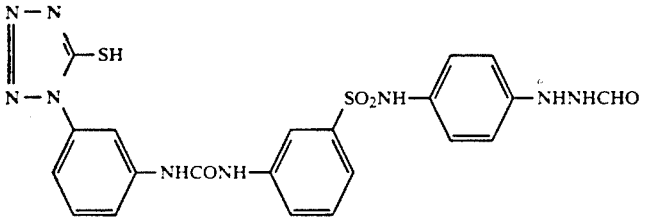
2-28)
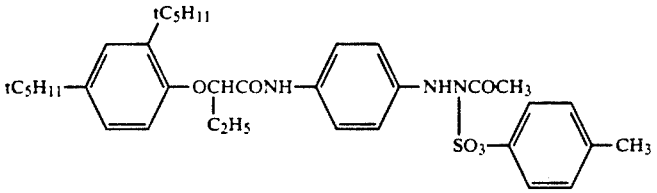
2-29)
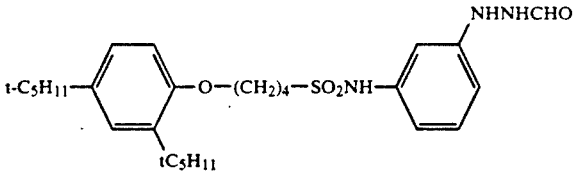
2-30)
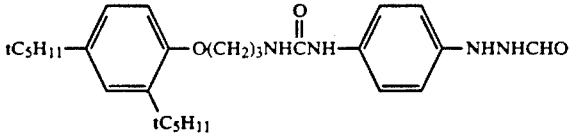
2-31)
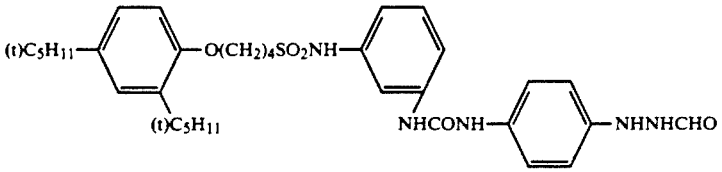

-continued
2-32)
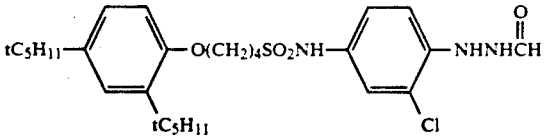
2-33)
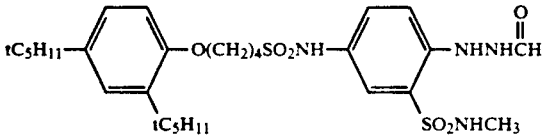
2-34)
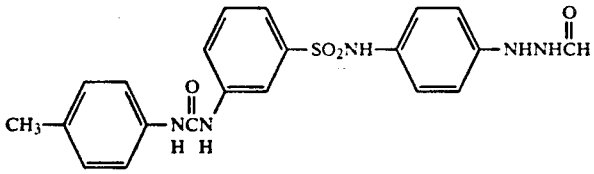
2-35)
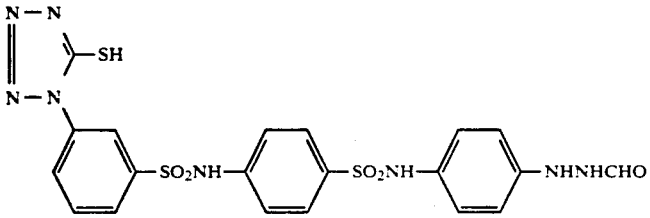
2-36)
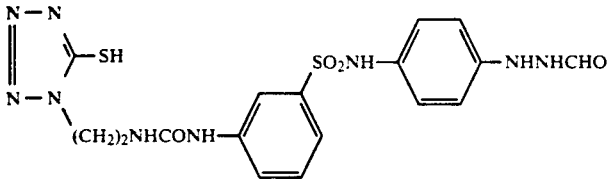
2-37)
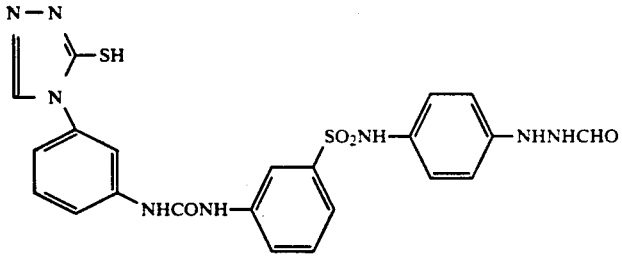
2-38)
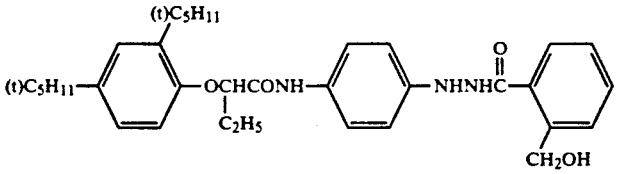
2-39)
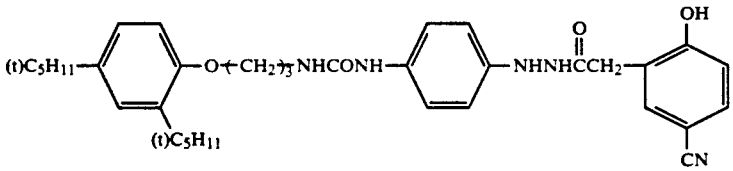

-continued
2-40)
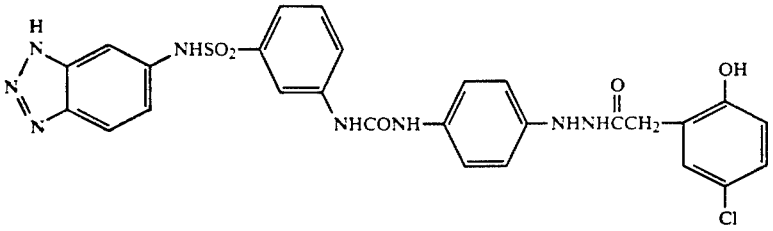
2-41)
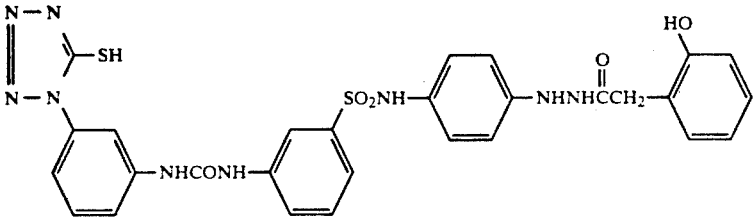
2-42)
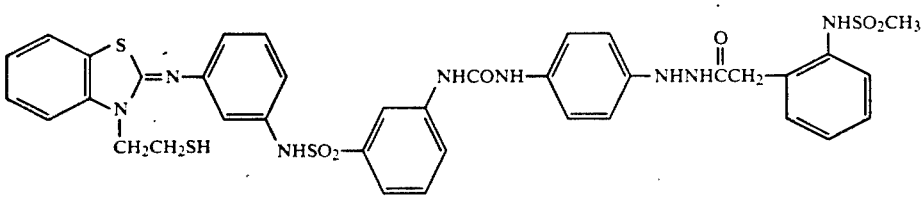
2-43)
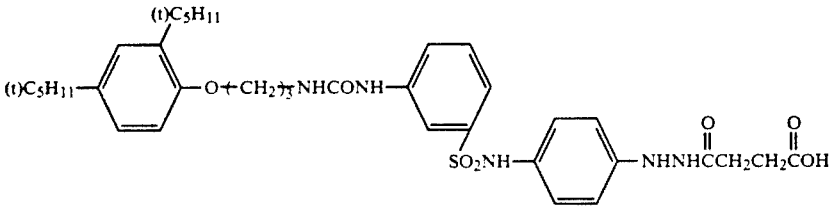
2-44)
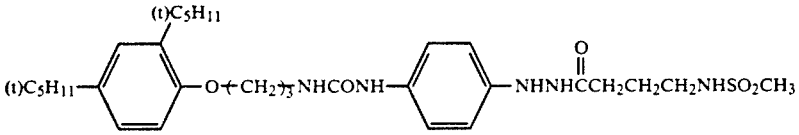
2-45)
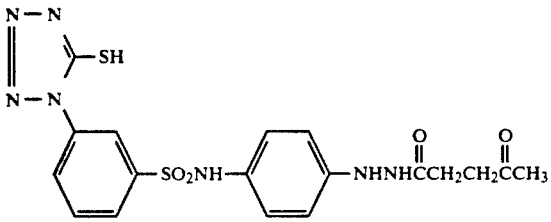
2-46)
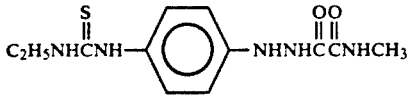
2-47)
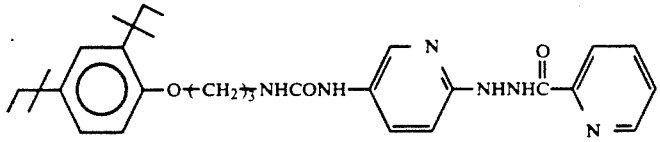

-continued
2-48)
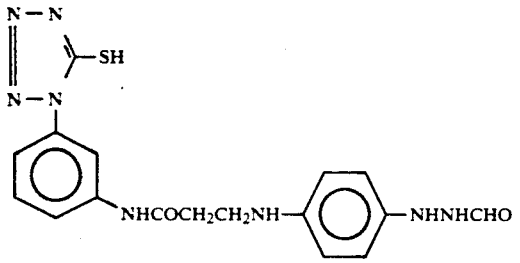
2-49)
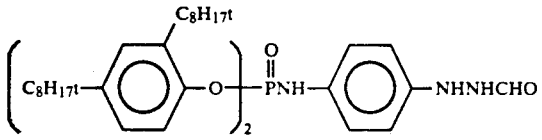
2-50)
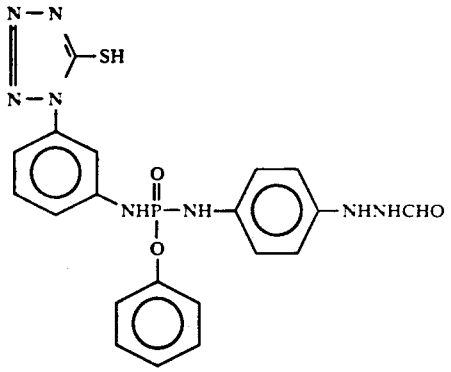
2-51)
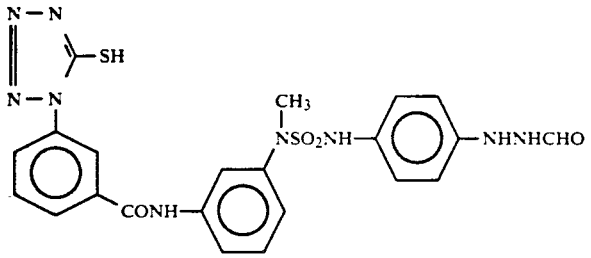
2-52)
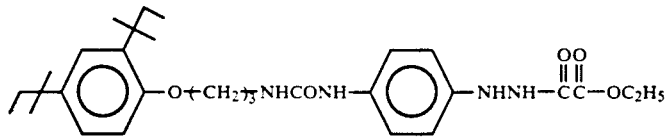
2-53)
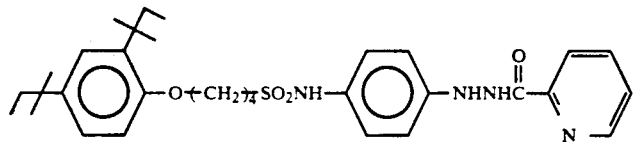
2-54)
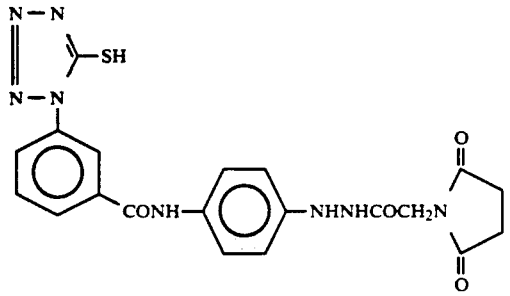

-continued
2-55)
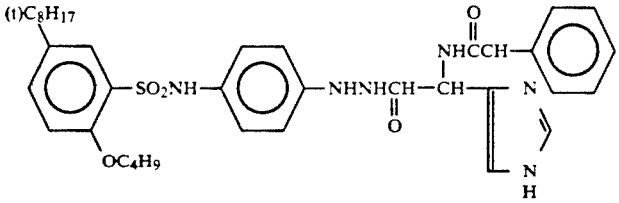
2-56)
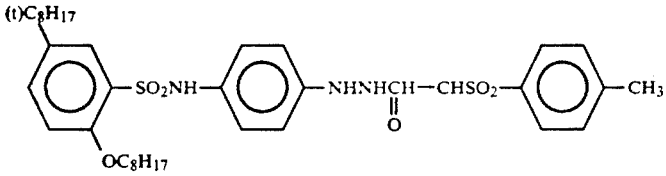
2-57)
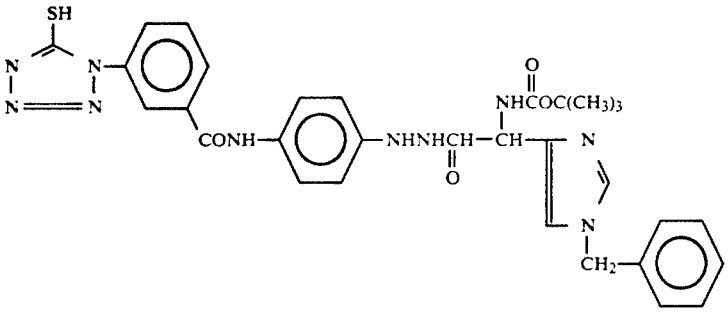
2-58)
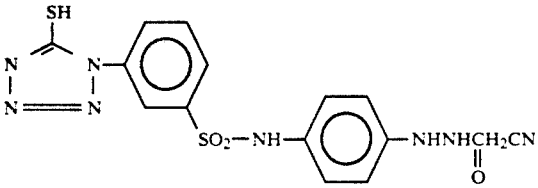
2-59)
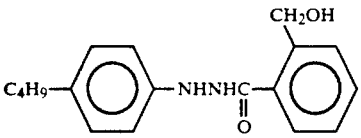
2-60)
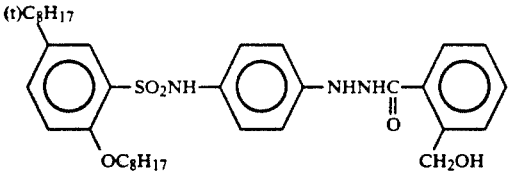
2-61)
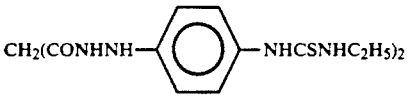
2-62)
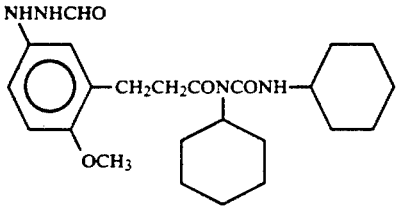

-continued 2-63)

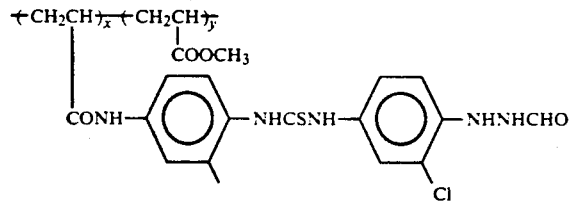

x:y = 3:97

$\overline{M} \approx 100,000$

Hydrazine derivatives usable in the present invention, in addition to the above-mentioned compounds, are described in *Research Disclosure*, Item No. 23516 (November, 1983, page 346) and the literature as referred to therein; as well as in U.S. Pat. Nos. 4,080,207, 4,269,929, 4,276,364, 4,278,748, 4,385,108, 4,459,347, 4,560,638, 4,478,928, British Patent 2,011,391B, European Patent 217,310 or U.S. Pat. No. 4,686,167, JP-A-60-179734, JP-A-62-270948, JP-A-63-29751, JP-A-61-170733, JP-A-61-270744, JP-A-62-948, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, and Japanese Patent Application Nos. 63-105682, 63-114118, 63-110051, 63-114119, 63-116239, 63-147339, 63-179760, 63-229163, Hei-1-18377, 1-18378, 1-18379, 1-15755, 1-16814, 1-40792, 1-42615, 1-42616, 1-123693, 1-126284.

In accordance with the present invention, the amount of the hydrazine derivative to be added to the photographic material is preferably from $1\times10^{-6}$ mol to $5\times10^{-2}$ mol, most preferably from $1\times10^{-5}$ mol to $2\times10^{-2}$ mol, per mol of the silver halide in the material.

The hydrazine derivatives can be incorporated into the photographic emulsion layer or hydrophilic colloid layer of the photographic material of the present invention.

By combining a compound of formula (1) and a hydrazine derivative of formula (2) with a negative emulsion, a negative image having high contrast can be formed. In addition, a compound of formula (1) and a derivative of formula (2) may also be combined with an internal latent image-type silver halide emulsion. It is preferred that a compound of formula (1) be combined with a hydrazine derivative of formula (2) and a negative emulsion for forming a negative image having high contrast.

Where a compound of formula (1) is utilized to form a negative image having high contrast, the silver halide grains employed are preferably fine grains having a mean grain size of 0.7 μm or less, more preferably 0.5 μm or less. Although the molecular size distribution of the silver halide grains is not specifically limited, the emulsion is preferably a monodispersed emulsion. The "monodispersed emulsion" as used herein means that at least 95% by number or by weight of the silver halide grains in the emulsion have a grain size falling within the range of the mean grain size, or plus or minus 40%.

The silver halide grains in the photographic emulsion may be regular crystals such as cubic, octahedral, rhombic dodecahedral or tetradecahedral crystals; they may be irregular crystals such as spherical or tabular crystals; or they may be composite crystals composed of a variety of regular and irregular crystal forms.

The silver halide grains may be composed of a uniform phase throughout the whole grain or a different phase inside the grain and at the surface layer of the grain.

The silver halide grains of the emulsion of the present invention may be formed or physically ripened in the presence of a cadmium salt, a sulfite, a lead salt, a thallium salt, a rhodium salt, a complex rhodium salt, an iridium salt, or a complex iridium salt.

Specifically, the silver halide grains for use in the present invention are prepared in the presence of an iridium salt or a complex iridium salt present in an amount of from $10^{-8}$ to $10^{-5}$ mol per mol of silver. These silver halide grains are silver haloiodides where the silver iodide content of the surface of the grain is larger than the mean silver iodide content of the whole grain. By using an emulsion containing such silver haloiodide grains, a photographic material having a much higher sensitivity and a much higher gamma value can be obtained.

The silver halide emulsion employed in the present invention may or may not be chemically sensitized. Chemical sensitization of silver halide grains is known using a sulfur sensitization, a reduction sensitization, or a noble metal sensitization. Any of these sensitizations can be employed singly or in a combination of two or more for chemical sensitization of the emulsion of the invention.

Gold sensitization is a typical noble metal sensitization method, which uses gold compounds that are essentially gold complexes. Needless to say, other noble metals, such as platinum, palladium, or rhodium, may also be used for a noble metal sensitization. Examples of the compounds usable in such sensitization methods are described in U.S. Pat. No. 2,448,060 and British Patent 618,016.

Examples of sulfur sensitizing agents are sulfur compounds that are contained in gelatin as well as other sulfur compounds, such as thiosulfates, thioureas, thiazoles and rhodanines. Any of these can be employed in the present invention.

In the above-mentioned chemical sensitization, it is preferred to use an iridium salt or a rhodium salt before the physical ripening of the silver halide emulsion is completed. More preferred is to use the sensitizer during formation of the silver halide grains.

In the present invention, it is preferred that the silver halide emulsion layer contains two mono-dispersed emulsions each having a different mean grain size as illustrated in JP-A-61-223734 and JP-A-62-90646, whereby the maximum density (Dmax) is elevated. Of the two emulsions, the small sized monodispersed grains are preferably chemically sensitized, most preferably by sulfur sensitization. The other large sized mono-dispersed grains may or may not be chemically sensitized.

Since sensitized large sized monodispersed grains often cause generation of black peppers, they are not generally chemically sensitized. However, if they are chemically sensitized, it is especially desired that the chemical sensitization is lightly effected so that it does not cause generation of black peppers. The phrase "chemical sensitization is lightly effected" means that the time of chemical sensitization of the large sized grains is shorter than that of the small sized grains, or the temperature is lowered, or the amount of the chemical sensitizing agent to be added is reduced. Although not specifically limited, the difference in the sensitivity between the large sized monodispersed emulsion and the small sized monodispersed emulsion is preferably from 0.1 to 1.0, more preferably from 0.2 to 0.7, as Δlog E. That is, it is preferred that the sensitivity of the large sized monodispersed emulsion is higher. The sensitivity of the emulsion is one as measured by coating an emulsion containing a hydrazine derivative on a support and processing the coated layer with a developer containing a sulfite ion in an amount of 0.15 mol/liter or more having a pH value of from 10.5 to 12.3. The mean grain size of the small sized monodispersed grains is 90% or less of that of the large sized monodispersed grains and is preferably 80% or less thereof. The mean grain size of the silver halide grains for use in the present invention is preferably within the range of from 0.02 μm to 1.0 μm, more preferably from 0.1 μm to 0.5 μm. It is more preferred that the mean grain sizes of both the large sized grains and the small sized grains are within the given ranges.

Where two or more emulsions each having a different mean grain size are employed in the present invention, the amount of the silver ion the small sized monodispersed emulsion coated is preferably from 40 to 90% by weight, more preferably from 50 to 80% by weight, of the total amount of silver coated.

Where two or more emulsions each having a different mean grain size are employed in the present invention, they may be incorporated into the same emulsion layer or may be separately incorporated into different emulsion layers. In the latter case of introducing the emulsions into different emulsion layers, it is preferred that the large sized emulsion layer is an upper layer and the small sized emulsion layer is a lower layer.

The total amount of silver coated is preferably from 1 $g/m^2$ to 8 $g/m^2$.

The photographic materials of the present invention can contain various sensitizing dyes, for example, those described in JP-A-55-52050, pages 45 to 53 (such as cyanine dyes or merocyanine dyes), for the purpose of elevating the sensitivity of the material. These sensitizing dyes may be added to the photographic material singly or in combinations of two or more. The combination of sensitizing dyes is often employed for the purpose of super color sensitization. Additionally, dyes which do not have a color sensitizing effect by themselves or substances which do not substantially absorb visible rays but have a super color sensitizing capacity may also be incorporated into the emulsion of the photographic material of the invention, along with the sensitizing dyes. Usable sensitizing dyes, combinations of dyes for super color sensitization and super color sensitizing substances are described in detail in *Research Disclosure*, Vol. 176, Item No. 17643 (December, 1978), page 23, JV-J.

The photographic materials of the present invention can contain various compounds for the purpose of preventing the materials from fogging during manufacture, storage, or photographic processing, or for the purpose of stabilizing the photographic properties of the materials. For instance, various compounds which are known as an antifoggant or stabilizer can be employed. These include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethione; azaindenes such as triazaindenes, tetraazaindenes (especially 4-hydroxy-substituted (1,3,3a,7)tetraazaindenes), pentaazaindenes; as well as benzenethiosulfonic acids, benzenesulfinic acids; and benzenesulfonic acid amides. Above all, benzotriazoles (for example, 5-methylbenzotriazole) and nitroindazoles (for example, 5-nitroindazole) are preferred. These compounds may be added to the processing solutions.

Examples of development accelerators or an accelerator for nucleating infectious development suitably employed in the present invention are the compounds illustrated in JP-A-53-77616, JP-A-54-37732, JP-A-53-137133, JP-A-60-140340 and JP-A-60-14959, as well as other compounds containing nitrogen and/or sulfur atom(s).

The optimum amount of accelerator applied to the photographic materials of the present invention, although varying in accordance with the kind of the compound of the agent, is desirably from $1.0\times10^{-3}$ to 0.5 $g/m^2$ and preferably from $5.0\times10^{-3}$ to 0.1 $g/m^2$.

The photographic materials of the present invention can contain a desensitizing agent in the photographic emulsion layer or in any other hydrophilic colloid layers.

A desensitizing agent for use in the present invention may be an organic desensitizing agent, as defined by the polarographic half-wave potential or by the oxidation reduction potential as determined by polarography. That is, the agent is defined so that the sum of the polarographic anode potential and the polarographic cathode potential is positive. The method of measuring the polarographic oxidation reduction potential is described, for example, in U.S. Pat. No. 3,501,307.

An organic desensitizing agent for use in the present invention is preferably one having at least one water-soluble group. For instance, the water-soluble group may be a sulfonic acid group, a carboxylic acid group, or a phosphonic acid group, and it may be in the form of a salt with an organic base (for example, ammonia, pyridine, triethylamine, piperidine or morpholine) or an alkali metal (for example, sodium or potassium).

As preferred organic desensitizing agents for use in the present invention, the compounds of formulae (III) to (V) described in JP-A-63-133145, pages 55 to 72 are mentioned.

In accordance with the present invention, the organic desensitizing agent is preferably incorporated into the silver halide emulsion layer in an amount of from $1.0\times10^{-8}$ to $1.0\times10^{-4}$ $mol/m^2$, preferably from $1.0\times10^{-7}$ to $1.0\times10^{-5}$ $mol/m^2$.

The photographic materials of the present invention can contain water-soluble dyes in the emulsion layer or in any other hydrophilic colloid layers, as a filter dye, for the purpose of antiirradiation, or for any other purpose known in the art. The filter dyes are those having a function of further lowering the photographic sensitivity of the photographic materials. They are preferably ultraviolet absorbents having a spectral absorption maximum in the intrinsic sensitivity range of the silver halides of the materials or dyes, and they exhibit substantial light absorption from about 380 nm to 600 nm for the purpose of elevating safety to a safelight when the materials are handled under daylight conditions.

These dyes are added to the emulsion layer, the upper layer of the silver halide emulsion layer, or the non-light-sensitive hydrophilic colloid layer depending on which is more remote from the support than the silver halide emulsion layer. The chosen dye(s) are preferably fixed to the layer along with a mordant agent.

Ultraviolet absorbents are added to the photographic materials in an amount of from $10^{-2}$ g/m$^2$ to 1 g/m$^2$, preferably from 50 mg/m$^2$ to 500 mg/m$^2$, in accordance with the molar extinction coefficient thereof.

The ultraviolet absorbents may be dissolved in a pertinent solvent (for example, water; alcohols, such as methanol, ethanol or propanol; acetone; methyl cellosolve; or mixed solvents) and the resulting solution added to the coating composition.

The ultraviolet absorbents usable in the present invention, for example, are aryl group-substituted benzotriazole compounds, 4-thiazolidone compounds, benzophenone compounds, cinnamic acid ester compounds, butadiene compounds, benzoxazole compounds, and ultraviolet absorbing polymers.

Specific examples of the usable ultraviolet absorbents are described, for example, in U.S. Pat. Nos. 3,533,794, 3,314,794, 3,352,681, 3,705,805, 3,707,375, 4,045,229, 3,700,455 and 3,499,762, West German Patent (OLS) No. 1,547,863, and JP-A-46-2784.

The filter dyes usable in the present invention include oxonol dyes, hemioxonol dyes, styryl dyes, merocyanine dyes, cyanine dyes, and azo dyes. For the purpose of decreasing the residual color in the photographic materials as developed, water-soluble dyes or dyes which may be decolored by alkali substances or sulfite ion are preferred as the filter dyes.

Specific examples of such filter dyes are the pyrazoloneoxonol dyes described in U.S. Pat. No. 2,274,782; the diarylazo dyes described in U.S. Pat. No. 2,956,879; the styryl dyes or butadienyl dyes described in U.S. Pat. Nos. 3,423,207 and 3,384,487; the merocyanine dyes described in U.S. Pat. No. 2,527,583; the merocyanine dyes or oxonol dyes described in U.S. Pat. Nos. 3,486,897, 3,652,284 and 3,718,472; the enaminohemioxonol dyes described in U.S. Pat. No. 3,976,661. In addition, the dyes described in British Patents 584,609 and 1,177,429, JP-A-48-85130, JP-A-49-99620, JP-A-49-114420, and U.S. Pat. Nos. 2,533,472, 3,148,187, 3,177,078, 3,247,127, 3,540,887, 3,575,704 and 3,653,905 may also be used.

The dyes are dissolved in an appropriate solvent (for example, water; alcohols, such as methanol, ethanol, or propanol; acetone; methyl cellosolve; or mixed solvents thereof). The resulting solution may be added to the coating composition to form the non-light-sensitive hydrophilic colloid layer in photographic materials of the present invention.

The preferred amount of the dyes to be incorporated into the layer may be from $10^{-3}$ g/m$^2$ to 1 g/m$^2$, more preferred is from $10^{-3}$ g/m$^2$ to 0.5 g/m$^2$.

The photographic materials of the present invention may contain an inorganic or organic hardening agent in the photographic emulsion layer or in any other hydrophilic colloid layers. For instance, chromium salts, aldehydes (e.g., formaldehyde, glutaraldehyde), N-methylol compounds (e.g., dimethylolurea), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine) and mucohalogenic acids can be employed singly or in combination of two or more of them as the hardening agent.

The photographic materials of the present invention can further contain various surfactants in the photographic emulsion layer or in any other hydrophilic colloid layers for various purposes such as coating assistance, prevention of static charge, improvement of slide properties, emulsification and dispersion, prevention of surface blocking, and improvement of photographic characteristics (for example, acceleration of developability, elevation of cotnrast and enhancement of sensitivity).

Surfactants especially preferably employed in the present invention are polyalkylene oxides having a molecular weight of 600 or more, such as those described in U.S. Pat. No. 4,221,857 and JP-B-58-9412 (the term "JP-B" as used herein refers to an "examined Japanese patent publication"). Where the surfactants employed act as an antistatic agent, fluorine-containing surfactants (described in detail in U.S. Pat. No. 4,201,586 and JP-A-60-80849 and JP-A-59-74554) are particularly preferred.

The photographic materials of the present invention may contain a matting agent such as silica, magnesium oxide, or polymethyl methacrylate in the photographic emulsion layer or in any other hydrophilic colloid layer to prevent surface blocking.

Additionally, the photographic materials of the present invention may also contain a dispersion of a water-insoluble or hardly water-soluble synthetic polymer in the photographic emulsion for the purpose of improving dimensional stability. For instance, polymers or copolymers composed of monomers of alkyl (meth)acrylates, alkoxyalkyl (meth)acrylates and/or glycidyl (meth)acrylates singly or in combinations. Optionally, these monomers may be employed along with other comonomers of acrylic acids and/or methacrylic acids.

The photographic materials of the present invention preferably contain an acid group-containing compound in the silver halide emulsion layer or in any other layers. As the acid group-containing compound can be, for example, organic acids (such as salicylic acid, acetic acid, or ascorbic acid) as well as polymers or copolymers composed of acid monomers (such as acrylic acid, maleic acid, or phthalic acid as the repeating unit). The description of these compounds is further detailed in JP-A-61-223834, JP-A-61-228437, JP-A-62-25745 and JP-A-62-55642. Among the compounds, ascorbic acid is especially preferred as an example of a low molecular compound, and a water-dispersed latex of a copolymer composed of an acid monomer such as acrylic acid and a crosslinking monomer having two or more unsaturated groups such as divinylbenzene is preferred as the example of a high molecular compound.

Photographic images having ultrahigh contrast and high sensitivity can be obtained by processing silver halide photographic materials of the present invention in infectious developers or high-alkali developers having a pH value of nearly 13 as described in U.S. Pat. No. 2,419,975, as well as in any stable developer.

Specifically, silver halide photographic materials of the present invention are processed with a developer containing sulfite ion as a preservative in an amount of 0.15 mol/liter or more and having a pH of from 10.5 to 12.3, preferably from 11.0 to 12.0, to obtain ultrahard negative images.

The developing agent of the developer used for processing the photographic materials of the present invention is not specifically limited. But it is preferred that the developer contain dihydroxybenzenes in order to yield good dot image quality. A combination of dihydroxybenzenes and 1-phenyl-3-pyrazolidones or a combination of dihydroxybenzenes and p-aminophenols may also be employed. In general, the developer preferably contains developing agent in an amount of from about 0.05 mol/liter to 0.8 mol/liter. Where the combination of dihydroxybenzenes and 1-phenyl-3-pyrazolidones or p-aminophenols is employed, the content of the former is preferably from about 0.05 mol/liter to 0.5 mol/liter and that of the latter is from 0.06 mol/liter or less.

Sulfite preservatives for use in the present invention are, for example, sodium sulfite, potassium sulfite, lithium sulfite, ammonium sulfite, sodium bisulfite, potassium metabisulfite, and formaldehyde-sodium metabisulfite. The concentration of the sulfite is preferably 0.4 mol/liter or more, preferably 0.5 mol/liter or more.

The developer to be employed in the present invention can contain the compounds described in JP-A-56-24347 as a silver stain inhibitor. The developer may further contain a solubilizer aid, which may be selected from the compounds described in U.S. Pat. No. 4,740,452 (corresponding to JP-A-61-267759). The developer may also contain a pH buffer, which may be selected from the compounds described in U.S. Pat. No. 4,569,904 (corresponding to JP-A-60-93433) or the compounds described in JP-A-62-186259.

The compound of formula (1) can be combined with a negative emulsion and incorporated into a high contrast photographic material as mentioned above. Additionally, it may be combined with an internal latent image type silver halide emulsion as described below. If combined with an internal latent image type silver halide emulsion, the compound of formula (1) is preferably incorporated into the internal latent image type silver halide emulsion layer. It may also be incorporated into the hydrophilic colloid layer adjacent to the internal latent image type silver halide emulsion layer. Such an adjacent layer may be a colorant-containing layer, an interlayer, a filter layer, a protective layer, or an antihalation layer, provided that it does not interfere with the diffusion of the nucleating agent into the silver halide grains of the adjacent emulsion layer.

The quantity of the compound of formula (1) in the emulsion layer may vary broadly depending on the characteristics of the silver halide emulsion used, the chemical structure of the nucleating agent, as well as the development conditions, but the practically useful range is from about 0.005 mg to about 500 mg per mol of silver in the internal latent image type silver halide emulsion. More preferably, the range of the quantity of the compound of formula (1) in the emulsion layer is from about 0.01 mg to about 100 mg per mol of silver. Where it is incorporated into the hydrophilic colloid layer adjacent to the emulsion layer, the amount of the compound may fall within the above-mentioned range based on the amount of silver contained in the same area of the adjacent internal latent image type emulsion layer. The details of the definition of the internal latent image type silver halide emulsion as referred to herein are described in JP-A-61-170733, page 10, upper column and British Patent 2,089,057, pages 18 to 20.

Specific examples of internal latent image type emulsions which are preferably employed in the present invention are described in JP-A-63-108336, from page 28, line 14 to page 31, line 2; and those of the silver halides which are preferably employed in the present invention are described in the same patent specification, from page 31, line 3 to page 32, line 11.

In the photographic materials of the present invention, the internal latent image type emulsions may optionally be color sensitized to blue light, green light, red light, or infrared light having a relatively long wavelength by the use of sensitizing dyes. Sensitizing dyes usable for the purpose are cyanine dyes, merocyanine dyes, complex cyanine dyes, complex merocyanine dyes, holopolar cyanine dyes, styryl dyes, hemicyanine dyes, oxonol dyes, and hemioxonol dyes. Such sensitizing dyes include the cyanine dyes and merocyanine dyes described in JP-A-59-40638, JP-A-59-40636, and JP-A-59-38739.

The photographic materials of the present invention can contain developing agents such as hydroxybenzenes (for example, hydroquinones), aminophenols, or 3-pyrazolidones. These can be included, for example, in the emulsion layer of the material.

The photographic emulsion of the present invention can be combined with a color diffusion transfer dye-forming compound (colorant) capable of releasing a diffusion dye with the development of the silver halide, in order to obtain a transfer image on an image-receiving layer after proper development. Various color diffusion transfer colorants of this type are known. Colorants that are originally nondiffusible, but are cleaved to release a diffusion dye by an oxidation reduction with the oxidation product of a developing agent (or an electron transfer agent) (hereinafter referred to as "DRR compounds") are preferably employed in the present invention. In particular, the DRR compounds containing an o-hydroxyarylsulfamoyl group described in U.S. Pat. Nos. 4,005,428, 4,053,312 and 4,336,322 and the DRR compounds containing a redox nucleus described in JP-A-53-149328 are especially preferred when they are combined with the nucleating agent of the present invention. By combining such DRR compounds and a nucleating agent of the present invention, the temperature dependence of the resulting photographic materials is noticeably lowered.

Examples of DRR compounds, in addition to those described above, are 1-hydroxy-2-tetramethylenesulfamoyl-4-[3'-methyl-4'-(2''-hydroxy-4''-methyl-5''-hexadecyloxyphenylsulfamoyl)phenylazo]naphthalene as a magenta dye image-forming substance and 1-phenyl-3-cyano-4-[(2''',4'''-di-tert-pentylphenoxyacetamino)-phenylsulfamoyl]phenylazo)-5-pyrazolone as a yellow dye image-forming substance.

It is preferred that the photographic materials of the present invention are imagewise exposed and then color developed with a surface developer containing an aromatic primary amine color developing agent and a pH value of 11.5 or less, during or after fogging treatment of the exposed material under light or with a nucleating agent. The thus developed material is bleached and fixed to form a direct positive color image. The developer to be used in the process preferably has a pH value of from 11.0 to 10.0.

The fogging treatment applied to the photographic material of the present invention in the above-mentioned process may be either a "light fogging method" where the complete surface of the light-sensitive layer is subjected to the second light exposure or a "chemical fogging method" where the material is developed in the presence of a nucleating agent. In addition to these methods, the material may also be developed in the presence of a nucleating light and under exposure to light. Alternatively, a nucleating agent may have been previously be incorporated into a photographic material, which is then subjected to fogging exposure.

The light fogging method is described in detail in JP-A-63-108336 (corresponding to European Patent 267,482A), from page 47, line 4 to page 49, line 5; and nucleating agents employable in the present invention are described in detail in the same patent application, from page 49, line 6 to page 67, line 2. In particular, the compounds of formulae (N-1) and (N-2) as mentioned therein are prefrred. Specific examples of the compounds are mentioned in the same patent application, and the compounds (N-I-1) to (N-I-10) described in pages 56 to 58 and the compounds (N-II-1) to (N-II-12) described in pages 63 to 66 are particularly preferred.

A nucleation accelerating agent can be employed in the present invention, and examples of the agent are described in the above-mentioned JP-A-63-108336, from page 68, line 11 to page 71, line 3. In particular, the compoiunds (A-1) to (A-13) mentioned in pages 69 to 70 of JP-A-63-108336 are especially preferably employed in the present invention.

The details of the color developer employable for development of the present invention are described in JP-A-63-108336, from page 71, line 4 to page 72, line 9. In particular, p-phenylenediamine compounds are especially preferred as the aromatic primary amine color developing agent to be used for developing the materials of the present invention. Specific examples of these compounds are 3-methyl-4-amino—N-ethyl—N-(β-methanesulfonamidoethyl)aniline; 3-methyl-4-amino—N-ethyl-N-(β-hydroxyethyl)aniline; 3-methyl-4-amino—N-ethyl—N-methoxyethylaniline; and salts of these compounds (such as sulfates or hydrochlorides).

Where a direct positve color image is formed from the photographic material of the present invention by a clor diffusion transfer process, black-and-white developing agents such as phenidone derivatives can be used in addition to the above-mentioned color developing agent.

The color developed photographic emulsion layer is generally bleached. Bleaching may be effected simultaneously with fixation by a monobath bleach-fixation system or separately. In order to accelerate the processing procedure, bleach-fixation may be effected before or after bleaching. The bleaching solution or bleach-fixing solution to be employed in the present invention generally contains an aminopolycarboxylate-iron complex as a bleaching agent. As additives to the bleaching solution or bleach-fixing solution various compounds can be employed. These are described in detail in JP-A-62-215272, at pages 22 to 30. After the desilvering step (bleach-fixation or fixation), the photographic materials are rinsed in water and/or stabilized. It is prefrred that softened water be used as the rinsing water or in the stabilizing solution. As the means for softening water the methods of using an ion exchange resin or a reverse osmosis apparatus, as described in detail in JP-A-62-288838, can be employed.

Additives usable in the rinsing or stabilization step are described in detail in JP-A-62-215272, pages 30 to 36.

The amount of the replenisher necessary in the respective processing steps is preferably small. The amount is preferably from 0.1 to 50 times, more preferably from 3 to 30 times, of the carry over of the previous bath per unit area of photographic material being processed.

The compounds of the present invention can be applied to heat developing photographic materials. Heat developing photographic materials are illustrated in, for example, U.S. Pat. Nos. 4,463,079, 4,474,867, 4,478,927, 4,507,380, 4,500,626, 4,483,914, JP-A-58-149046, JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, JP-A-59-174835, JP-A-61-232451, JP-A-62-65038, JP-A-62-253159, JP-A-63-316848, JP-A-64-13546, and European Patent Laid-Open Nos. 210,660A2, 220,746A2.

The above-mentioned heat developing photographic materials essentially have light-sensitive silver halides, binders, dye-forming compounds and reducing agents (as the case may be, dye-forming compounds may also act as a reducing agent), on a support. If desired, the materials may further contain organic silver salts and other additives.

The above-mentioned heat developing materials may be either those capable of forming negative images by exposure or those capable of forming positive images by exposure. The system of forming positive images may be either a system of using a direct positive emulsion as a silver halide emulsion or a system of using a dye-forming compound capable of positively releasing a diffusion dye image. The former system includes two types, one is to use a nucleating agent and the other is to be fogged with light.

There are a variety of diffusion dye transfer systems, which are, for example, a system of transferring a diffusion dye to a dye-fixing layer by the action of an image-forming solvent such as water, a system of transferring a diffusion dye to a dye-fixing layer by the action of a high boiling point organic solvent, a system of transferring a diffusion dye to a dye-fixing layer by the action of a hydrophilic heat solvent, and a system of transferring a diffusion dye to a dye-receiving polymer-having dye-fixing layer by means of the heat diffusibility or sublimability of the diffusion dye. Any one of the said systems can be employed in the present invention.

As an example of the above-mentioned image-forming solvent, there is known water, and the water is not limited to only a pure water but it may be a so-called ordinary water with a broad meaning.

EXAMPLES

The following examples are intended to illustrate the present invention in more detail but not to limit it in any way. Unless otherwise indicated, all parts and percents are by weight.

EXAMPLE 1

Preparation of Light-Sensitive Emulsion

An aqueous solution of silver nitrate, and an aqueous solution of potassium iodide and potassium bromide were simultaneously added to an aqueous gelatin solution kept at 50° C. in the presence of $4\times10^{-7}$ mol per mol of silver of potassium iridium(III) hexachloride and ammonia, over a period of 60 minutes. The pAg of the reaction system was maintained at 7.8. This resulted in a cubic monodispersed emulsion having a mean grain size of 0.28 μm and a mean silver iodide content of 0.3 mol %. The emulsion was desalted by flocculation, and inert gelatin was added in an amount of 40 g per mol of silver. This was added to a $10^{-3}$ mol per mol of silver of KI solution of 50° C. containing a sensitizing dye of 5,5'-dichloro-9-ethyl-3,3'-bis(3-sulfopropyl)oxacarbocyanine. The mixture was allowed to stand for 15 minutes and the temperature of the reaction system was lowered to 8° C.

Coating the Light-Sensitive Layer

The emulsion prepared above was redissolved and the following hydrazine derivatives were added thereto at 40° C.

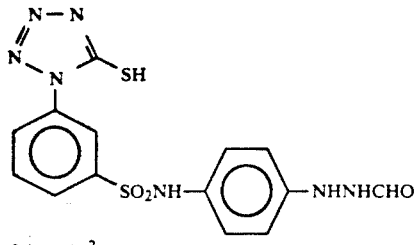

0.6 mg/m²

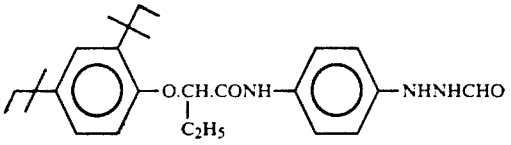

2.8 mg/m²

Next, a compound of formula (1) of the invention or a comparative compound, as indicated in Table 1, below, were added. Additionally, 5-methylbenzotriazole, 4-hydroxy-1,3,3a,7-tetraazaindene, Compounds (a) and (b), polyethyl acrylate 30 wt % to gelatin, and Compound (c) (a gelatin hardening agent) were added. The resulting composition was coated on a polyethylene terephthalate film (thickness: 150 μm) having a vinylidene copolymer subbing layer (thickness: 0.5 μm), in an amount of 3.8 g/m² of silver.

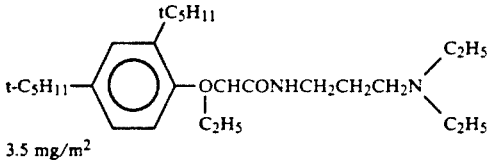

3.5 mg/m²

(a)

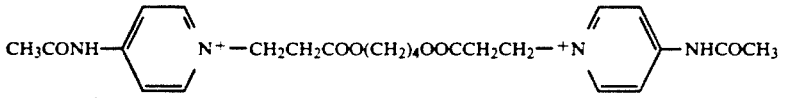

15.0 mg/m²

(b)

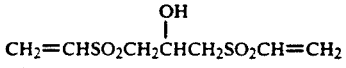

2.0 wt % to gelatin (c)

Coating the Protective Layer

A protective layer comprising 1.5 g/m² of gelatin and 0.3 g/m² of polymethyl methacrylate grains (mean grain size: 2.5 μm) were coated over the emulsion layer using the following surfactants.

Surfactants:

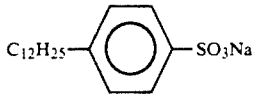

37 mg/m²

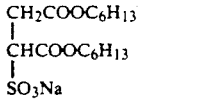

37 mg/m²

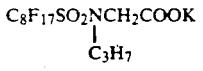

2.5 mg/m²

Evaluation of Photographic Properties

The samples thus prepared were exposed to a tungsten light of 3,200° K. through an optical wedge and a contact screen (150 Chain Dot Type, manufactured by Fuji Photo Film Co., Ltd.) and developed with the following developer at 34° C. for 30 seconds, fixed, rinsed in water, and dried.

| Composition of Developer: | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)-benzenesulfonic Acid | 0.2 g |
| N-n-Butyldiethanolamine | 15.0 g |
| Sodium Toluenesulfonate | 8.0 g |
| Water to make | 1 liter |
| Potassium Hydroxide to make pH of | 11.0 |

The dot image quality and the dot gradation of these processed samples were measured. The results obtained are shown in Table 1, below. The dot gradation was represented by the following formula:

$$(\Delta \log E) = (\log E\ 95\%) - (\log E\ 5\%)$$

(ΔlogE): Dot gradation, (logE 95%): amount of exposure of giving 95% dot area ratio, (logE 5%): amount of exposure of giving 5% dot area ratio.

The dot quality was visually evaluated by five ranks. In this five rank evaluation, "5" is the best and "1" is the worst. The ranks "5" and "4" are practical for use as a dot image plate in photomechanical printing; the rank "3" is the critical level for the practical use; and the ranks "2" and "1" indicate emulsions that are practically useless.

The results obtained are shown in Table 1 below.

As shown in Table 1, the compounds of the present invention were extremely effective for improving or broadening the dot gradation of the processed samples. Thus, samples containing compounds of the invention exhibited an unexpected improvement in dot image quality, compared to the samples containing the comparative compounds according to the prior art.

TABLE 1

| Sample | Kind of Compound Added | Amount Added ($mol/m^2$) | Dot Gradation ($\Delta logE$) | Dot Image Quality |
|---|---|---|---|---|
| Comparative Example | Comparative Compound | | | |
| 1 | — | — | 1.19 | 3 |
| 2 | a | $2.0 \times 10^{-5}$ | 1.32 | 4 |
| 3 | b | " | 1.23 | 3 |
| 4 | c | " | 1.20 | 3 |
| 5 | d | " | 1.19 | 3 |
| Example | Compound (according to the invention) | | | |
| 1 | 2 | $2.0 \times 10^{-5}$ | 1.45 | 4 |
| 2 | 3 | " | 1.43 | 4 |
| 3 | 8 | $3.0 \times 10^{-6}$ | 1.42 | 4 |
| 4 | 19 | $2.0 \times 10^{-5}$ | 1.46 | 5 |
| 5 | 21 | " | 1.47 | 5 |
| 6 | 24 | " | 1.35 | 4 |
| 7 | 26 | " | 1.40 | 4 |
| 8 | 30 | " | 1.35 | 4 |
| 9 | 23 | " | 1.38 | 4 |

Comparative Compound-a (according to JP-A-61-213847)

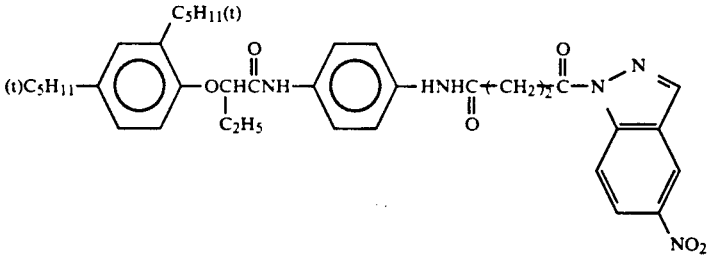

Comparative Compound-b (according to JP-A-61-213847)

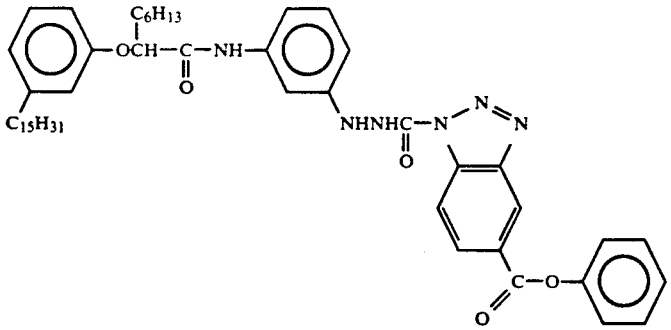

Comparative Compound-c (according to U.S. Pat. No. 4,684,604)

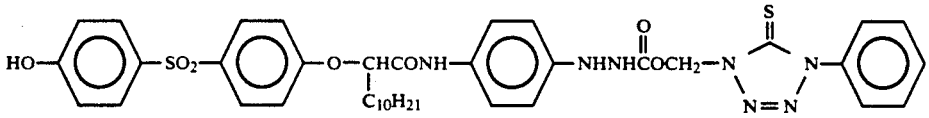

Comparative Compound-d (according to U.S. Pat No. 4,684,604)

TABLE 1-continued

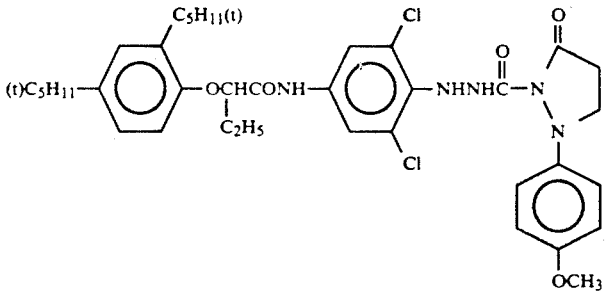

EXAMPLE 2

The same samples as those of Example 1 were exposed in the same manner as described in Example 1. These sampels were processed using a photomechanical process automatic developing machine (Type FG660F, manufactured by Fuji Photo Film Co., Ltd.), using the same developer as described in Example 1 in the machine. The samples were developed for 30 seconds at 34° C. under the following conditions, fixed, rinsed in water, and dried.

Developing Conditions (A) (Development with fresh solution) Immediately after the temperature of the developer in the developing machine reached 34° C., development was started.

(B) (Development with air fatigued solution) The developer in the developing machine was allowed to stand for 4 days before the development was started.

(C) (Development with forcedly fatigued solution by developing a lot of sheets) The developing machine was filled with developer, and 200 sheets/day of a partially exposed film so that 50% of the area of the film was developed after processing (Fuji Film GRANDEX GA-100) having a size of 50.8 cm×61.0 cm were developed with the machine for 5 days, whereupon 100 cc/sheet of a fresh developer was replenished.

The photographic properties of the thus processed samples are shown in Table 2, below. In view of the running processing stability, it is desired that the difference between the photographic properties obtained by Process (B) or (C) and those obtained by Process (A) be negligible. As shown in Table 2, the running processing stability of the samples containing the compounds of the present invention was unexpectedly improved over those containing the comparative compounds of the prior art.

TABLE 2

| | Sample No. | Running Processing Stability: Air Fatigued ($\Delta S_{B-A}$)* | Forcedly Fatigued ($\Delta S_{C-A}$)* |
|---|---|---|---|
| 1 | Comparative Example 1 | +0.07 | −0.14 |
| 2 | Comparative Example 2 | +0.04 | −0.08 |
| 3 | Comparative Example 3 | +0.07 | −0.14 |
| 4 | Comparative Example 4 | +0.08 | −0.15 |
| 5 | Comparative Example 5 | +0.07 | −0.15 |
| 6 | Example 1 of the Invention | +0.03 | −0.06 |
| 7 | Example 2 of the Invention | +0.03 | −0.06 |
| 8 | Example 3 of the Invention | +0.03 | −0.07 |
| 9 | Example 4 of the Invention | +0.02 | −0.07 |
| 10 | Example 5 of the Invention | +0.02 | −0.06 |
| 11 | Example 6 of the Invention | +0.03 | −0.07 |
| 12 | Example 7 of the Invention | +0.03 | −0.07 |
| 13 | Example 8 of the Invention | +0.03 | −0.07 |
| 14 | Example 9 of the Invention | +0.03 | −0.06 |

*($\Delta S_{B-A}$): Difference between the sensitivity ($S_B$) as developed with air fatigued solution and the sensitivity ($S_A$) as developed with fresh solution.
*($\Delta S_{C-A}$) Difference between the sensitivity ($S_C$) as developed with forcedly fatigued solution and the sensitivity ($S_A$) as developed with fresh solution.

EXAMPLE 3

An aqueous silver nitrate solution and an aqueous sodium chloride solution were simultaneously added to and blended with an aqueous gelatin solution of 50° C. in the presence of $5.0\times10^{-6}$ mol of $(NH_4)_3RhCl_6$ per mol of silver, and the soluble salts removed. Gelatin was added. The mixture was not chemically ripened, rather a stabilizer of 2-methyl-4-hydroxy-1,3,3a,7-tetraazaindene (1.3 mg/m$^2$) was added to it. The result was a monodispersed emulsion containing cubic grains having a mean grain size of 0.15 μm. The following hydrazine compound (49 mg/m$^2$) was added to the emulsion.

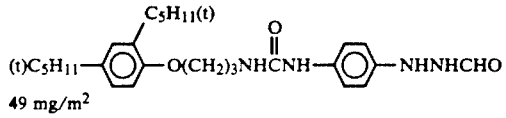

49 mg/m$^2$

Next, a compound of the invention or a comparative compound, as indicated in Table 3 below, was then added. Additionally, a polyethyl acrylate latex (30 wt % to gelatin) and a hardening agent of 1,3-vinylsulfonyl-2-propanol were added. The resulting composition was coated on a polyester support in an amount of 3.8 g/m$^2$ of Ag. The gelatin content in the coated layer was 1.8 g/m$^2$. Next, a protective layer comprising gelatin (1.5 g/m$^2$); a mat agent of polymethyl methacrylate grains (mean grain size: 2.5 μm) at 0.3 g/m$^2$; the following surfactants as coating aids; the following stabilizers; and the following ultraviolet absorbing dye were coated over the formed emulsion layer and dried.

Surfactants:

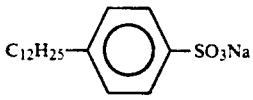

37 mg/m²

$CH_2COOC_6H_{13}$
|
$CHCOOC_6H_{13}$
|
$SO_3Na$ 37 mg/m²

$C_8F_{17}SO_2NCH_2COOK$
|
$C_3H_7$ 2.5 mg/m²

Stabilizer

Thioctic Acid 2.1 mg/m²

Ultraviolet Absorbing Dye:

100 mg/m²

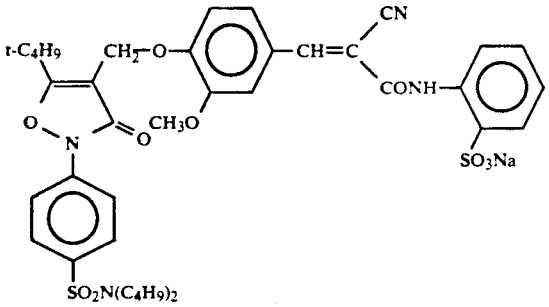

Figure 1B:
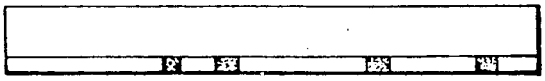
Figure 1C:
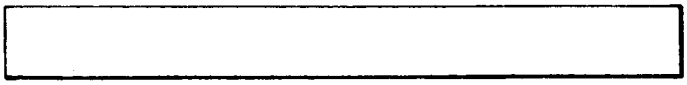
Figure 1D:
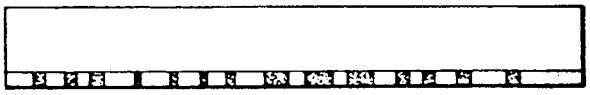
Figure 1E:
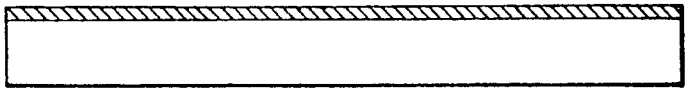

These samples were imagewise exposed through an embodiment of the invention as illustrated in FIG. 1 using a daylight printer (P-607, manufactured by Dai-Nippon Screen Co.) and developed at 38° C. for 20 seconds, fixed, rinsed in water, and dried. The thus processed samples were evaluated with respect to the quality of the superimposed letter image formed by way of a 5-rank evaluation.

For the 5-rank superimposed letter image evaluation, the photographic material sample was perperly exposed through an embodiment of the invention as illustrated in FIG. 1 so that 50% of the dot area of the original would be 50% of the dot area of the reproduced image on the sample by contact dot-to-dot work. The rank "5" in the evaluation indicates that 30 μm width letters were well reproduced and the superimposed letter image quality was excellent. The rank "1" indicates that only letters of 150 μm width or more were reproduced and the superimposed letter image quality was bad. The other rankings of from "4" to "2" were conducted by functional evaluation. Ranks of "3" or more indicate the practical working level.

The results are shown in Table 3 below. These results illustrate that the samples of the present invention have excellent superimposed letter image quality.

TABLE 3

| Sample No. | Kind of Compound Added | Amount Added (mol/m²) | Superimposed Letter Image Quality |
|---|---|---|---|
| 1 (Comparison) | — | — | 3.0 |
| 2 (Comparison) | Comparative Compound-a | $5.0 \times 10^{-5}$ | 3.5 |
| 3 (Comparison) | Comparative Compound-b | " | 3.0 |

TABLE 3-continued

| Sample No. | Kind of Compound Added | Amount Added (mol/m²) | Superimposed Letter Image Quality |
|---|---|---|---|
| 4 (Comparison) | Comparative Compound-c | " | 3.0 |
| 5 (Comparison) | Comparative Compound-d | " | 3.0 |
| 6 (Invention) | Compound 3 | $5.0 \times 10^{-5}$ | 4.0 |
| 7 (Invention) | Compound 19 | " | 4.0 |
| 8 (Invention) | Compound 21 | " | 4.5 |
| 9 (Invention) | Compound 14 | " | 4.5 |
| 10 (Invention) | Compound 16 | " | 5.0 |
| 11 (Invention) | Compound 4 | $7.0 \times 10^{-6}$ | 4.5 |
| 12 (Invention) | Compound 22 | " | 4.5 |
| 13 (Invention) | Compound 26 | $5.0 \times 10^{-5}$ | 4.0 |
| 14 (Invention) | Compound 23 | " | 4.0 |

EXAMPLE 4

Emulsions for photographic layers, a dispersion of zinc hydroxide, a dispersion of active charcoal, a dispersion of an electron transmitting agent, dispersions of yellow, magenta, and cyan couplers and a dispersion for an interlayer were prepared as mentioned below. Using them, a photographic material (Sample No. 801) was prepared, as mentioned below. Additionally, an image-receiving material was prepared, also as mentioned below.

Emulsion for Blue-Sensitive Layer

The following Solution (1) and Solution (2) were simultaneously added to a well stirred aqueous gelatin solution (which was prepared by adding 20 g of gelatin, 3 g of potassium bromide, 0.03 g of the following Compound (1) and 0.25 g of $HO(CH_2)_2S(CH_2)_2S(CH_2)_2OH$ to 800 cc of water and heated at 50° C.), over a period of 30 minutes. Afterwards, the following Solution (3) and Solution (4) were further added thereto at the same time over a period of 20 minutes. 5 minutes after the initiation of adding Solution (3), a dye solution mentioned below was added over a period of 18 minutes.

After washed with water and desalted, 20 g of lime-processed ossein gelatin was added, the pH was adjusted to 6.2, and the pAg to 8.5. Next, sodium thiosulfate, 4-hydroxy-6-methyl-1,3,3a,7-tetraazaindene and chloroauric acid were added for optimum chemical sensitization. Thus, 600 g of a monodispersed cubic silver chlorobromide emulsion having a mean grain size of 0.40 μm was obtained.

| | Solution (1) | Solution (2) | Solution (3) | Solution (4) |
|---|---|---|---|---|
| $AgNO_3$ | 30 g | — | 70 g | — |
| KBr | — | 17.8 g | — | 49 g |
| NaCl | — | 1.6 g | — | — |
| Water to make | 180 cc | 180 cc | 350 cc | 350 cc |

Dye Solution

The following dyes were dissolved in 160 cc of methanol.

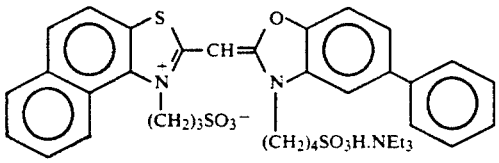

0.18 g

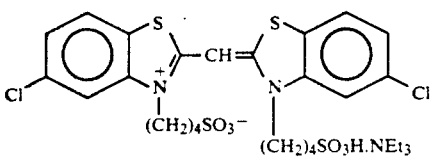

0.06 g

Compound (1):

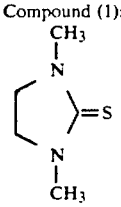

Emulsion for Green-Sensitive Layer

The following Solutions (I) and (II) were added to an aqueous gelatin solution (see below) well stirred and heated at 50° C., over a period of 30 minutes. Next, Solutions (III) and (IV) were added over a period of 30 minutes, whereupon a dye solution mentioned below was added 1 minute after the completion of the addition of Solutions (III) and (IV).

| | |
|---|---|
| Gelatin | 20 g |
| NaCl | 6 g |
| KBr | 0.3 g |

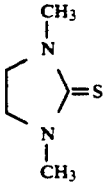

0.015 g

| | |
|---|---|
| $H_2O$ | 730 ml |

| | Solution (I) | Solution (II) | Solution (III) | Solution (IV) |
|---|---|---|---|---|
| $AgNO_3$ | 50 g | — | 50 g | — |
| KBr | — | 21 g | — | 28 g |
| NaCl | — | 6.9 g | — | 3.5 g |
| Water to make | 200 cc | 200 cc | 200 cc | 200 cc |

Thus, a monodispersed cubic emulsion having a grain size of 0.40 μm was obtained. The yield was 63 g.

Composition of Dye Solution:

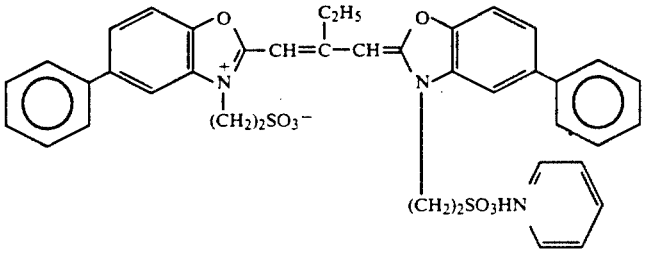

0.23 g

Methanol 154 cc

After being washed with water and desalted, 20 g of gelatin was added, the pH and pAg were adjusted, and triethylthiourea, chloroauric acid and 4-hydroxy-6-methyl-1,3,3a,7-tetraazaindene were added for optimum chemical sensitization.

Emulsion for Red-Sensitive Layer

The following Solutions (V) and (VI) were added to a well stirred aqueous gelatin solution (which was prepared by adding 20 g of gelatin, 0.3 g of potassium bromide, 6 g of sodium chloride and 30 mg of the following Compound (1) to 800 ml of water and heated at 50° C.) at the same time and at the same flow rate over a period of 30 minutes. Afterwards, the following Solutions (VII) and (VIII) were also added at the same time over a period of 30 minutes. 3 minutes after the initiation of adding Solutions (VII) and (VIII), a dye solution mentioned below was added over a period of 20 minutes.

After being washed with water and desalted, 22 g of lime-processed ossein gelatin was added, the pH was adjusted to 6.2, and the pAg to 7.7. Next, sodium thiosulfate, 4-hydroxy-6-methyl-1,3,3a,7-tetraazaindene and chloroauric acid were added for optimum chemical sensitization at 60° C. Thus, a monodispersed cubic silver chlorobromide emulsion having a mean grain size of 0.38 μm was obtained. The yield was 635 g.

| | Solution (V) | Solution (VI) |
|---|---|---|
| $AgNO_3$ | 50.0 g | — |
| KBr | — | 28.4 g |
| NaCl | — | 3.4 g |
| Water to make | 200 ml | 200 ml |

| | Solution (VII) | Solution (VIII) |
|---|---|---|
| $AgNO_3$ | 50.0 g | — |
| KBr | — | 35.0 g |
| Water to make | 200 ml | 200 ml |

Compound (1):

-continued

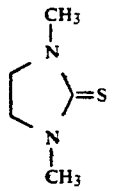

Dye Solution 67 mg of the following Dye (a) and 133 mg of the following Dye (b) were dissolved in 100 ml of methanol.

Dye (a):

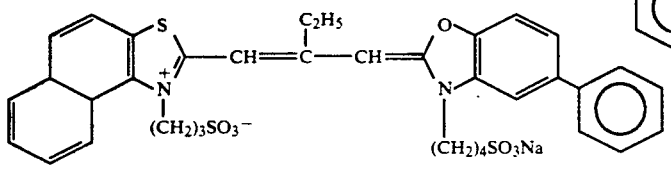

Dye (b):

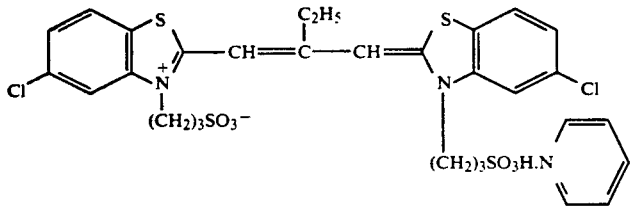

Next, a dispersion of zinc hydroxide was prepared as mentioned below.

12.5 g of zinc hydroxide having a mean grain size of 0.2 μm, 1 g of carboxymethyl cellulose as a dispersing agent, and 0.1 g of sodium polyacrylate were added to 100 cc of a 4% aqueous gelatin solution and milled for 30 minutes with glass beads having a mean grain size of 0.75 mm. The glass beads were removed, and a dispersio of zinc hydroxide was obtained.

A dispersion of active charcoal was prepared as follows:

2.5 g of active charcoal powder (special grade chemical, product by Wako Pure Chemical), 1 g of Demole N (product by Kao Soap Co.) as a dispersing agent, and 0.25 g of polyethylene glycol nonylphenylether were added to 100 cc of a 5% aqueous gelatin solution, and milled for 120 minutes with glass beads having a mean grain size of 0.75 mm. After the glass beads were removed, a dispersion of active charcoal having a mean grain size of 0.5 μm was obtained.

A dispersion of an electron transmitting agent was prepared as follows:

10 g of an electron transmitting agent mentioned below, 0.5 g of polyethylene glycol as a dispersing agent, and 0.5 g of an anionic surfactant mentioned below were added to a 5% aqueous gelatin solution, and milled for 60 minutes with glass beads having a mean grain size of 0.75 mm. After the glass beads were removed, a dispersio of an electron transmitting agent having a mean grain size of 0.3 μm was obtained.

Electron Transmitting Agent:

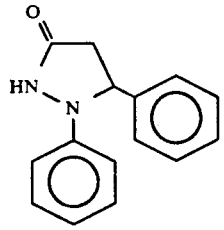

Anionic Surfactant:

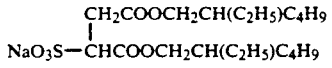

Gelatin dispersions each containing a dye-forming compound were prepared as mentioned below.

A yellow, magenta or cyan dye-forming composition as indicated below was added to 50 cc of ethyl acetate and dissolved under heat at about 60° C. to form a uniform solution. This was blended with 100 g of 10% lime-processed gelatin-containing aqueous solution, 0.6 g of sodium dodecylbenzenesulfonate and 50 cc of water by stirring and then dispersed for 10 minutes with a homogenizer at 10,000 rpm. The dispersion thus prepared is called a gelatin dispersion of a dye-forming compound.

| | Yellow | Magenta | Cyan |
|---|---|---|---|
| Dye Forming Compound Mentioned Below | (1) 13 g | (2) 15.5 g | (3) 16.6 g |
| Electron Donating Compound (1) Mentioned Below | 10.2 g | 8.6 g | 8.1 g |
| High Boiling Point Solvent (2) Mentioned Below | 6.5 g | 7.8 g | 8.3 g |
| Electron Transmitting Agent Precursor (3) Mentioned Below | 0.4 g | 0.7 g | 0.7 g |

-continued
| | | | |
|---|---|---|---|
| Compound (A) Mentioned Below | 3.9 g | — | — |
Dye Forming Compound (1):
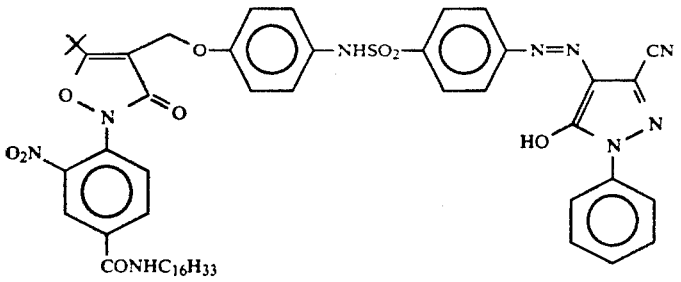
Dye Forming Compound (2):
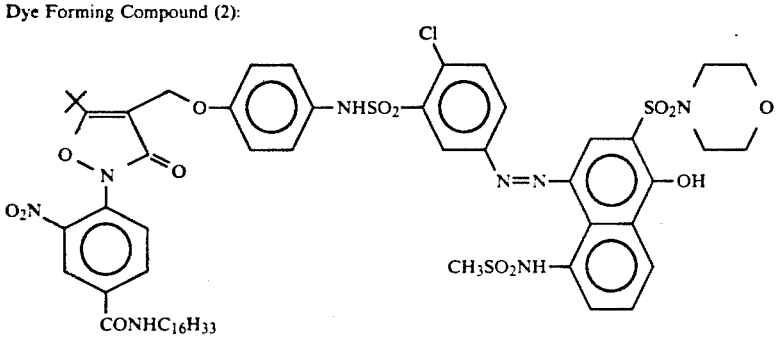
Dye Forming Compound (3):
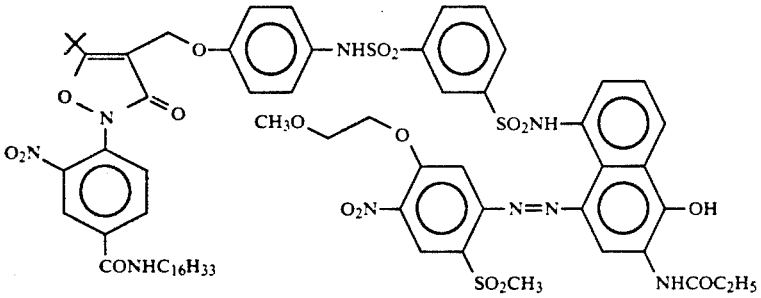
Electron Donating Compound (1):
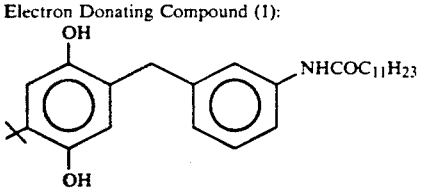
High Boiling Point Solvent (2):
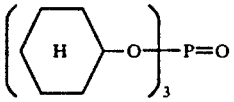
Electron Transmitting Agent Precursor (3):
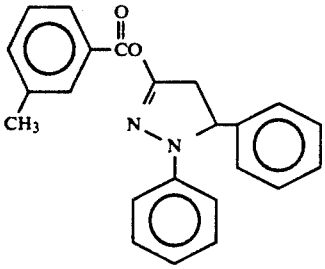

-continued

Compound (A):

$CO_2C_{12}H_{25}$
|
$CO_2C_{12}H_{25}$

A gelatin dispersion of electron donating compound (4) for an interlayer was prepared as mentioned below.

23.6 g of the following Electron Donating Compound (4) and 8.5 g of the above-mentioned High Boiling Point Solvent (2) were added to 30 cc of ethyl acetate to form a uniform solution. The solution was blended with 100 g of a 10% aqueous solution of lime-processed gelatin, 0.25 g of sodium hydrogensulfite, 0.3 g of sodium dodecylbenzenesulfonate, and 30 cc of water with stirring, and then dispersed for 10 minutes with a homogenizer at 10,000 rpm. The resulting dispersion is called a gelatin dispersion of Electron Donating Compound (4).

Electron Donating Compound (4):

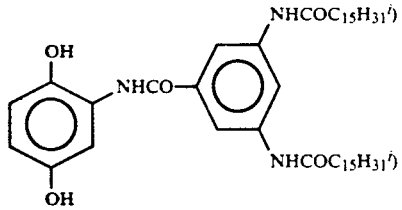

Constitution of Sample No. 801 was as follows:

| | |
|---|---|
| Sixth Layer: Protective Layer | |
| Gelatin | 900 mg/m$^2$ |
| Silica (size: 4 μm) | 40 mg/m$^2$ |
| Zinc Hydroxide | 900 mg/m$^2$ |
| Surfactant (5) (*1) | 130 mg/m$^2$ |
| Surfactant (6) (*2) | 26 mg/m$^2$ |
| Polyvinyl Alcohol | 63 mg/m$^2$ |
| Lactose | 155 mg/m$^2$ |
| Water-Soluble Polymer (*3) | 8 mg/m$^2$ |
| Fifth Layer: Blue-Sensitive Emulsion Layer | |
| Light-Sensitive Silver Halide Emulsion | 380 mg/m$^2$ as Ag |
| Antifoggant (7) (*4) | 0.9 mg/m$^2$ |
| Gelatin | 560 mg/m$^2$ |
| Yellow Dye Forming Compound (1) | 400 mg/m$^2$ |
| Electron Donating Compound (1) | 320 mg/m$^2$ |
| Electron Transmitting Agent Precursor (3) | 25 mg/m$^2$ |
| Compound (A) | 120 mg/m$^2$ |
| High Boiling Point Solvent (2) | 200 mg/m$^2$ |
| Surfactant (8) (*5) | 45 mg/m$^2$ |
| Water-Soluble Polymer (*3) | 13 mg/m$^2$ |
| Fourth Layer: Interlayer | |
| Gelatin | 555 mg/m$^2$ |
| Electron Donating Compound (4) | 130 mg/m$^2$ |
| High Boiling Point Solvent (2) | 48 mg/m$^2$ |
| Electron Transmitting Agent (10) (*7) | 85 mg/m$^2$ |
| Surfactant (6) (*2) | 15 mg/m$^2$ |
| Surfactant (8) (*5) | 4 mg/m$^2$ |
| Surfactant (9) (*6) | 30 mg/m$^2$ |
| Polyvinyl Alcohol | 30 mg/m$^2$ |
| Lactose | 155 mg/m$^2$ |
| Water-Soluble Polymer (*3) | 19 mg/m$^2$ |
| Hardening Agent (11) (*8) | 37 mg/m$^2$ |
| Third Layer: Green-Sensitive Emulsion Layer | |
| Light-Sensitive Silver Halide Emulsion | 220 mg/m$^2$ as Ag |
| Antifoggant (12) (*9) | 0.7 mg/m$^2$ |
| Gelatin | 370 mg/m$^2$ |

-continued

| | |
|---|---|
| Magenta Dye Forming Compound (2) | 350 mg/m$^2$ |
| Electron Donating Compound (1) | 195 mg/m$^2$ |
| Electron Transmitting Agent Precursor (3) | 33 mg/m$^2$ |
| High Boiling Point Solvent (2) | 175 mg/m$^2$ |
| Surfactant (8) (*5) | 47 mg/m$^2$ |
| Water-Soluble Polymer (*3) | 11 mg/m$^2$ |
| Second Layer: Interlayer | |
| Gelatin | 650 mg/m$^2$ |
| Zinc Hydroxide | 300 mg/m$^2$ |
| Electron Donating Compound (4) | 130 mg/m$^2$ |
| High Boiling Point Solvent (2) | 50 mg/m$^2$ |
| Surfactant (6) (*2) | 11 mg/m$^2$ |
| Surfactant (8) (*5) | 4 mg/m$^2$ |
| Surfactant (9) (*6) | 50 mg/m$^2$ |
| Polyvinyl Alcohol | 50 mg/m$^2$ |
| Lactose | 155 mg/m$^2$ |
| Water-Soluble Polymer (*3) | 12 mg/m$^2$ |
| Active Charcoal | 25 mg/m$^2$ |
| First Layer: Red-Sensitive Emulsion Layer | |
| Light-Sensitive Silver Halide Emulsion | 230 mg/m$^2$ as Ag |
| Antifoggant (12) (*9) | 0.7 mg/m$^2$ |
| Gelatin | 330 mg/m$^2$ |
| Cyan Dye Forming Compound (3) | 340 mg/m$^2$ |
| Electron Donating Compound (1) | 133 mg/m$^2$ |
| Electron Transmitting Agent Precursor (3) | 30 mg/m$^2$ |
| High Boiling Point Solvent (2) | 170 mg/m$^2$ |
| Surfactant (8) (*5) | 40 mg/m$^2$ |
| Water-Soluble Polymer (*3) | 5 mg/m$^2$ |
| Support: | |
| Polyethylene Terephthalate (96 μm thick) (carbon black was added to the backing | |

-continued layer)

Compounds used above are as follows:

(*1) Surfactant (5):

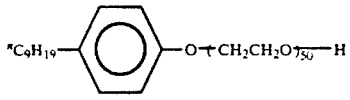

(*2) Surfactant (6):

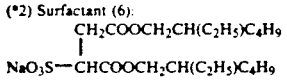

(*3) Water-Soluble Polymer:

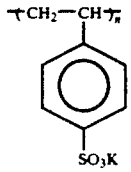

(*4) Antifoggant (7):

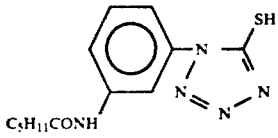

(*5) Surfactant (8):

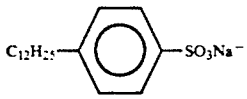

(*6) Surfactant (9):

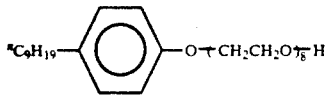

(*7) Electron Transmitting Agent (10):

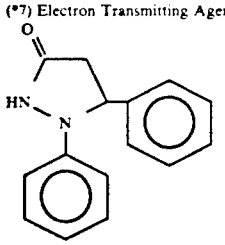

(*8) Hardening Agent (11):
1,2-Bis(vinylsulfonylacetamide)ethane (*9) Antifoggant (12):

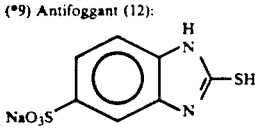

Composition of image receiving material used herein was as follows:

| | |
|---|---|
| Third Layer: | |
| Gelatin | 0.05 g/m$^2$ |
| Silicone Oil (1) | 0.04 g/m$^2$ |
| Surfactant (1) | 0.001 g/m$^2$ |
| Surfactant (2) | 0.02 g/m$^2$ |
| Surfactant (3) | 0.10 g/m$^2$ |
| Matting Agent (1) | 0.02 g/m$^2$ |
| Guanidine Picolinate | 0.45 g/m$^2$ |
| Water-Soluble Polymer (1) | 0.24 g/m$^2$ |
| Second Layer: | |
| Mordant Agent (1) | 2.35 g/m$^2$ |
| Water-Soluble Polymer (1) | 0.20 g/m$^2$ |
| Gelatin | 1.40 g/m$^2$ |
| Water-Soluble Polymer (2) | 0.60 g/m$^2$ |
| High Boiling Point Solvent (1) | 1.40 g/m$^2$ |
| Guanidine Picolinate | 2.25 g/m$^2$ |
| Brightening Agent (1) | 0.05 g/m$^2$ |

-continued

| | |
|---|---|
| Surfactant (5) | 0.15 g/m$^2$ |
| First Layer: | |
| Gelatin | 0.45 g/m$^2$ |
| Surfactant (3) | 0.01 g/m$^2$ |
| Water-Soluble Polymer (1) | 0.04 g/m$^2$ |
| Hardening Agent (1) | 0.30 g/m$^2$ |
| Support (1): See below. | |
| First Backing Layer: | |
| Gelatin | 3.25 g/m$^2$ |
| Hardening Agent (1) | 0.25 g/m$^2$ |
| Second Backing Layer: | |
| Gelatin | 0.44 g/m$^2$ |
| Silicone Oil (1) | 0.08 g/m$^2$ |
| Surfactant (4) | 0.04 g/m$^2$ |
| Surfactant (5) | 0.01 g/m$^2$ |
| Matting Agent (2) | 0.03 g/m$^2$ |

Constitution of Support (1) was as follows:

| | |
|---|---|
| Surface Subbing Layer: | 0.1 μm (thickness) |
| Gelatin | |
| Surface PE Layer (glossy): | 45.0 μm (thickness) |
| Low Density Polyethylene (density: 0.923) | 89.2 parts |
| Surface-Treated Titanium Oxide | 10.0 parts |
| Ultramarine | 0.8 parts |
| Pulp Layer: | 92.6 μm (thickness) |
| High Quality Paper (LBKP/NBKP = 1/1, density: 1.080) | |
| Back Surface PE Layer (matting): | 36.0 μm (thickness) |
| High Density Polyethylene (density: 0.960) | |
| Back Surface Subbing Layer: | |
| Gelatin | 0.05 μm (thickness) |
| Colloidal Silica | 0.05 μm (thickness) |
| Total | 173.8 μm (thickness) |

Compounds used above are as follows:

Silicone Oil (1):

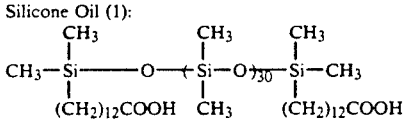

Surfactant (1):

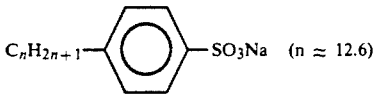

Surfactant (2):

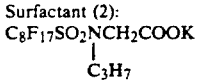

Surfactant (3):

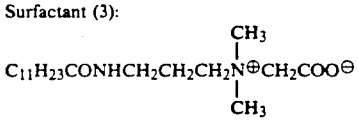

Surfactant (4):

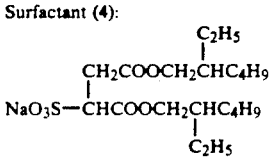

Brightening Agent (1):
2,5-Bis[5-tert-butylbenzoxazolyl(2)]thiophene

Surfactant (5):

-continued

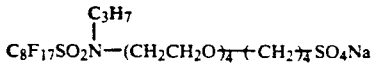

Water-Soluble Polymer (1):
Sumicagel L 5-H (product by Sumitomo Chemical)

Water-Soluble Polymer (2):
Dextran (molecular weight: 70,000)

Mordant Agent (1):

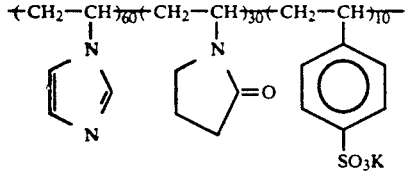

High Boiling Point Solvent (1):

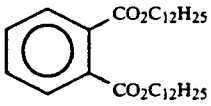

Hardening Agent (1):

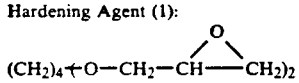

Matting Agent (1)*:
Silica

Matting Agent (2)*:
Benzoguanamine Resin (mean grain size: 15 μm)

In the same manner as the preparation of Sample No. 801, other Sample Nos. 802 to 805 were prepared, as indicated in Table 4 below. Sample Nos. 802 to 805 each contained a compound of the present invention, which had been dispersed in gelatin by an oil dispersion method, in the Second and Fourth layers each in an amount of $3\times10^{-5}$ mol/m$^2$.

Sample Nos. 801 to 805 thus prepared were exposed with a spectrophotometric camera through an optical wedge where the optical density continuously varied in the direction vertical to the wavelength.

The exposed samples were then wetted with water by applying a hot water (35° C.) to the emulsion surface of each sample in an amount of 15 ml/m$^2$ for 3 seconds. The thus wetted sample was attached to the previously prepared image receiving material so that the coated surfaces of the two faced to each other.

The combined sample was then heated with a heat roller for 15 seconds whereupon the temperature of the wetted layer was adjusted to 78° C. Next, the image receiving material was peeled off from the photographic material and, as a result, a blue-green-red spectrogram was formed on the image receiving layer in accordance with the wavelength of the light as exposed.

The density of each of the yellow, magenta and cyan colors was measured with 310 Type Densitometer (manufactured by X-rite Co.). The results obtained are shown in Table 4 below.

TABLE 4

| | Comparison | Invention | | | |
|---|---|---|---|---|---|
| | 801 | 802 | 803 | 804 | 805 |
| Compound Added to Second and Fourth Layers | — | (1) | (8) | (29) | (34) |
| Blue-Exposed Region | | | | | |
| Yellow | 0.75 | 0.60 | 0.65 | 0.65 | 0.60 |
| Magenta | 2.00 | 2.15 | 2.05 | 2.10 | 2.10 |
| Cyan | 2.05 | 2.15 | 2.10 | 2.10 | 2.15 |
| Green-Exposed Region | | | | | |
| Yellow | 1.90 | 2.05 | 2.00 | 2.05 | 2.05 |
| Magenta | 0.70 | 0.55 | 0.60 | 0.60 | 0.55 |
| Cyan | 2.00 | 2.15 | 2.10 | 2.10 | 2.15 |
| Red-Exposed Region | | | | | |
| Yellow | 1.90 | 2.00 | 1.95 | 2.00 | 2.00 |
| Magenta | 1.90 | 2.05 | 2.00 | 1.95 | 2.10 |
| Cyan | 0.40 | 0.30 | 0.35 | 0.35 | 0.30 |

From the results above, it is noted that the density of all the blue, green and red colors increased by addition of the compound of the present invention. Additionally, the color purity also increased by such addition, since the complementary color component decreased. Accordingly, it was proved that the compounds of the present invention had an excellent capacity of improving the color reproducibility.

Next, the above-mentioned photographic material samples were stored for 1 month under the condition of 30° C. and 70% RH and then subjected to the same treatment as described above. After the treatment, the same results as those in the above-mentioned Table 4 were obtained. Accordingly, it was confirmed that the compounds of the present invention have no harmful influence on the stabilities with the laps of time of the photographic materials containing the same.

EXAMPLE 5

Each of 0.825 mmol/m$^2$ of Compound (1), (6), (30), and (27) of the present invention was added to the timing layer of the cover sheet of Example 1 of JP-A-63-289551 to prepare Cover Sheets (9-1), (9-2), (9-3), and (9-4). Each of these cover sheets was attached to Light-Sensitive Sheet (102) of the same example and then processed in the same manner as in the same example. The liquid spreading temperature was 10° C., 25° C. and 35° C.

As a result, it was found that all the samples had little processing temperature dependence and had excellent photographic properties with a high Dmax value and a low Dmin value.

EXAMPLE 6

A light-sensitive sheet was prepared in the same manner as in Example 5, except that the same molar amount of Compound (36) of the present invention was used in place of the yellow dye releasing redox compound in the Tenth layer.

The light-sensitive sheet was combined with the cover sheet and the processing solution of Example 1 of JP-A-63-289551 and processed at 25° C. in the same manner as in the same example.

It was found that the light-sensitive sheet of the present invention had a rapid speed of increasing B density and a short period of time of completing the color image. Accordingly, the sheet of the present invention could form a color image in a short period of time.

EXAMPLE 7

3 mg/m$^2$ of Compound (1), (29) or (34) of the present invention was added to each of the Third, Fourth, Sixth, Seventh, Ninth and Tenth Layers of Sample No.

102 of Example 1 of JP-A-1-112241, respectively, to prepare Samples (11-1), (11-2) and (11-3).

These samples were processed in the manner as described in the same example, and it was confirmed that all these samples had an excellent color reproducibility.

EXAMPLE 8

15 mg of Compound (1) of the present invention was added to the Third, Fourth, Fifth, Seventh, Eighth, Ninth, Eleventh, Twelfth, and Thirteenth Layers of Sample No. 101 of Example 1 of JP-A-1-267638 to prepare Sample No. (8-1). This was processed and evaluated in accordance with the manner described in the same example. As a result, the sample was proved to have excellent sharpness and color reproducibility.

EXAMPLE 9

20 mg of Compound (28) of the present invention was added to the Fourth, Fifth, Sixth, Ninth, Tenth, Eleventh, Fourteenth, Fifteenth and Sixteenth Layers of Sample (208) of Example 2 of JP-A-1-291250 to prepare Sample No. (9-1). This was processed in accordance with the manner described in the same example. As a result, the sample was found to have excellent sharpness, graininess and color reproducibility.

EXAMPLE 10

3 mg/m$^2$ of Compound (1) of the present invention was added to each of the Third, Fourth, Sixth, Seventh, Eleventh and Twelfth Layers of Sample (502) of Example 4 of European Patent 327066A to prepare Sample No. (10-1). This was processed in accordance with the manner described in the same example. As a result, the sample was found to have an excellent color reproducibility.

EXAMPLE 11

Compound (1) of the present invention was added to the emulsion layer of Sample (1) of Example 1 of JP-A-1-234840 in an amount of 560 mg per mol of the silver halide in the layer to prepare Sample No. (11-1). This was processed in accordance with the manner described in the same example.

As a result, the sample formed a high quality image having a high black density.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one compound represented by general formula (1):

$$R-Y-NH-L-NHNH-\underset{\underset{O}{\|}}{C}(Time)_t-PUG \qquad (1)$$

wherein

R represents an aliphatic group, an aromatic group, or a heterocyclic group;

both L and Time represent a divalent organic group, wherein Time is a group capable of releasing PUG from the moiety Time-PUG which is released from the oxidation product of the at least one compound represented by general formula (1);

t represents 0 or 1;

PUG represents (1) a development inhibitor, (2) a diffusible or non-diffusible dye, (3) a bleach accelerator, or (4) a developing agent which is a hydroquinone, an aminophenol, a phenylenediamine, or a pyrazolidone;

and Y represents $-SO_2-$, $-Y'-SO_2-$, or $$-Y'-\overset{\overset{O}{\|}}{\underset{\underset{R-Y'}{|}}{P}}-;$$

and Y' represents —O—, —NH—, or $$-\underset{\underset{R}{|}}{N}-.$$

2. The silver halide photographic material as in claim 1, which further contains at least one hydrazine derivative of formula (2):

$$R_{31}-\underset{\underset{A_1}{|}}{N}-\underset{\underset{A_2}{|}}{N}-G_1-R_{32} \qquad (2)$$

wherein $R_{31}$ represents an aliphatic group or an aromatic group; $R_{32}$ represents a hydrogen atom, an alkyl group, an aryl group, an alkoxy group, an aryloxy group, an amino group, a carbamoyl group, or an oxycarbonyl group; $G_1$ represents a $-\overset{\overset{O}{\|}}{C}-$ group, an $-SO_2-$ group, an $-SO-$ group, a $-\overset{\overset{O}{\|}}{\underset{\underset{R_{32}}{|}}{P}}-$ group, a $-\overset{\overset{O}{\|}}{C}-\overset{\overset{O}{\|}}{C}-$ group, a thiocarbonyl group, or an iminomethylene group; and both $A_1$ and $A_2$ are hydrogen atoms, or one of them is a hydrogen atom and the other represents a substituted or unsubstituted alkylsulfonyl group, a substituted or unsubstituted arylsulfonyl group, or a substituted or unsubstituted acyl group.

3. The silver halide photographic material as in claim 1, wherein the amount of the compound of general formula (1) is from $1\times10^{-6}$ to $5\times10^{-2}$ mol per mol of silver halide in said photographic material.

4. The silver halide photographic material as in claim 1, wherein the amount of the compound of general formula (1) is from $1\times10^{-5}$ to $1\times10^{-2}$ mol per mol of silver halide in said photographic material.

5. The silver halide photographic material as in claim 2, wherein the amount of the compound of general formula (2) is from $1\times10^{-6}$ to $5\times10^{-2}$ mol per mol of silver halide in said photographic material.

6. The silver halide photographic material as in claim 2, wherein the amount of the compound of general formula (2) is from $1\times10^{-5}$ to $3\times10^{-2}$ mol per mol of silver halide in said photographic material.

* * * * *